US007812512B2

(12) United States Patent
Nishimura et al.

(10) Patent No.: US 7,812,512 B2
(45) Date of Patent: Oct. 12, 2010

(54) FIELD EMISSION ELECTRODE, METHOD AND APPARATUS OF MANUFACTURING THE SAME BY CARRYING A HUMIDIFICATION PROCESS AND AN AGING PROCESS

(75) Inventors: Kazuhito Nishimura, Nankoku (JP); Hideki Sasaoka, Kochi (JP)

(73) Assignees: Kochi Industrial Promotion Center, Kochi-shi (JP); Casio Computer Co., Ltd., Tokyo (JP)

( * ) Notice: Subject to any disclaimer, the term of this patent is extended or adjusted under 35 U.S.C. 154(b) by 189 days.

(21) Appl. No.: 12/239,061

(22) Filed: Sep. 26, 2008

(65) Prior Publication Data

US 2009/0088040 A1 Apr. 2, 2009

(30) Foreign Application Priority Data

Sep. 28, 2007 (JP) ..... 2007-256825

(51) Int. Cl.

| | |
|---|---|
| ***H01J 1/30*** | (2006.01) |
| ***H01J 1/304*** | (2006.01) |
| ***H01J 9/02*** | (2006.01) |
| ***H01J 9/44*** | (2006.01) |

(52) U.S. Cl. ..... 313/495; 313/311; 313/310; 445/6; 445/62

(58) Field of Classification Search ..... 313/495–497, 313/309–311; 445/6, 62

See application file for complete search history.

(56) References Cited

FOREIGN PATENT DOCUMENTS

JP 2000-243291 A 9/2000

*Primary Examiner*—Mariceli Santiago
(74) *Attorney, Agent, or Firm*—Holtz, Holtz, Goodman & Chick, PC

(57) ABSTRACT

A method of manufacturing a field emission electrode includes humidification processing to absorb water at a surface of an electron emission film emitting electrons as a result of application of a voltage, and voltage application processing to apply an aging voltage between the humidified electron emission film and an electrode provided facing the electron emission film.

15 Claims, 41 Drawing Sheets

FIELD EMISSION ELECTRODE, METHOD AND APPARATUS OF MANUFACTURING THE SAME BY CARRYING A HUMIDIFICATION PROCESS AND AN AGING PROCESS

BACKGROUND OF THE INVENTION

1. Field of the Invention

The present invention relates to a field emission electrode that emits electrons due to field emissions, a manufacturing method thereof, and a manufacturing apparatus thereof.

2. Description of Related Art

A field emission electrode is capable of emitting cold electrons in a vacuum as a result of the application of a strong field to an emitter and is noted as an electron emission element that can replace a hot cathode. Various researches are being made to bring about a lower threshold field intensity and achieving stability and uniformity of emission current.

Structures such as those utilizing carbon film such as carbon nanotubes as a field emission electrode are well known.

It is well known that, typically, with field emission electrodes, when polar molecular gas such as water vapor is absorbed at a surface of an electron emission site (taken to be "water molecules" hereafter because most of the residual gas within a vacuum chamber evacuated from atmospheric pressure can be considered to be that which desorbs absorbed water molecules within the chamber), a work function of an emitter surface is reduced and an electron emission characteristic is improved (a high number of electron emissions at a lower field intensity). It is also well known that an absorption state to the electron emission element for the water molecules changes according to the degree of vacuum and that the electron emissions are dependent on the degree of vacuum.

This changing of the characteristics by absorbing of molecules enables the electron emission characteristics to be improved on the one hand (larger number of electron emissions with a lower field intensity), while on the other hand degrading the degree of vacuum because molecules that have adhered to electron emission sites are desorbed in a vacuum with electron beam irradiation. Degradation of the degree of vacuum means an increase in ionized molecules and ions due to the electron beam irradiation that then collide with the electron emission element due to the electrical field, thus causing the electron emission element to be degraded. The degradation is also subject to positive feedback as a result of a large amount of gas being desorbed from the emitter surface as a result of the collisions. If the degree of vacuum degrades by more than a certain extent, the ion collisions will promote spark discharges. This will cause substantial damage to the electron emission element and the surrounding electrode structure. It is therefore typical for products utilizing field electron emission elements to be provided with a process for removing gas from the electron emission element and the electrode structure driving the electron emission element (even in the case of water molecules provided to improve the electron emission characteristics). Many patent applications have been made with regards to such methods.

Heating processing in an evacuated vacuum state referred to as baking and processing referred to as aging disclosed in Unexamined Japanese Patent Application KOKAI Publication No. 2000-243291 taking degassing as an object are well known as methods for degassing electron emission elements and their anodes.

This invention is taking the lead in forming electron emission films including nanodiamond fine particles of a particle diameter smaller than 1 μm using plasma CVD techniques.

However, with plasma CVD, it is difficult to make active species density uniform across the entire surface of a substrate where a nanodiamond fine particle layer is formed and bias occurs in the electron emission characteristics of the electron emission film according to the position of the substrate. When bias in the electron emission characteristics is made uniform using normal aging means (removal by combustion of low field electron emission sites in the electron emission film) using techniques to make the bias in the electron emission characteristics uniform, characteristics of portions where the electron emission characteristics are weak are made uniform and the total quantity of electron emissions for the emitter is substantially reduced.

In order to resolve the situation described above, the present invention is advantageous in providing a method of manufacturing a field emission electrode having comparatively uniform electron emission density, a field emission electrode, and a manufacturing apparatus.

SUMMARY OF THE INVENTION

In order to achieve the above object, a method of manufacturing a field emission electrode of a first aspect of the present invention comprises:

humidification processing to absorb water at a surface of an electron emission film emitting electrons; and voltage application processing to apply an aging voltage between the humidified electron emission film and an electrode provided facing the electron emission film.

It is preferable for at least a surface of the electrode facing the electron emission film to be hydrophilic.

It is also preferable for a fluorescent substance to be applied to the surface of the electrode facing the electron emission film.

A vacuum heating step of heating the electron emission film in a vacuum state and removing water from the electron emission film may be also provided.

The vacuum heating step is preferably carried out at 550 to 1000 degrees centigrade.

The electron emission film may also have a carbon nanowall having a graphene sheet.

The electron emission film may also be provided with a microcrystal diamond film on the carbon nanowall.

The electron emission film may also be further provided with projections made of graphite formed so as to project upwards from the microcrystal diamond film.

The aging voltage is preferably a pulse voltage.

The pulse voltage preferably has a duty ratio of 0.2 to 5%.

The pulse voltage is preferably a voltage giving an electron emission density of 0.5 mA/cm$^2$ to 5 mA/cm$^2$ at the beginning for the electron emission film.

A repeating period of the pulse voltage is preferably 250 Hz to 1 kHz.

Water at the surface of the electron emission film are preferably absorbed as a result of exposure to a humidified atmosphere.

In order to achieve the above object, a field emission electrode of a second aspect of the present invention is made by a method of manufacturing a field emission electrode of the first aspect.

In order to achieve the above object, a manufacturing apparatus of a field emission electrode of a third aspect of the present invention carries out humidification processing to absorb water at a surface of an electron emission film emitting electrons, and applies an aging voltage between the humidified electron emission film and an electrode provided facing the electron emission film.

According to the present invention, it is possible to provide a method of manufacturing a field emission electrode capable of making electron emission density comparatively uniform, a field emission electrode, and a manufacturing apparatus by carrying out absorption and desorption of water to and from a surface of the field emission electrode.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENTS

An explanation is given using the drawings of a method of manufacturing a field emission electrode, a field emission electrode, and a manufacturing apparatus according to embodiments of the present invention.

Figure 1:
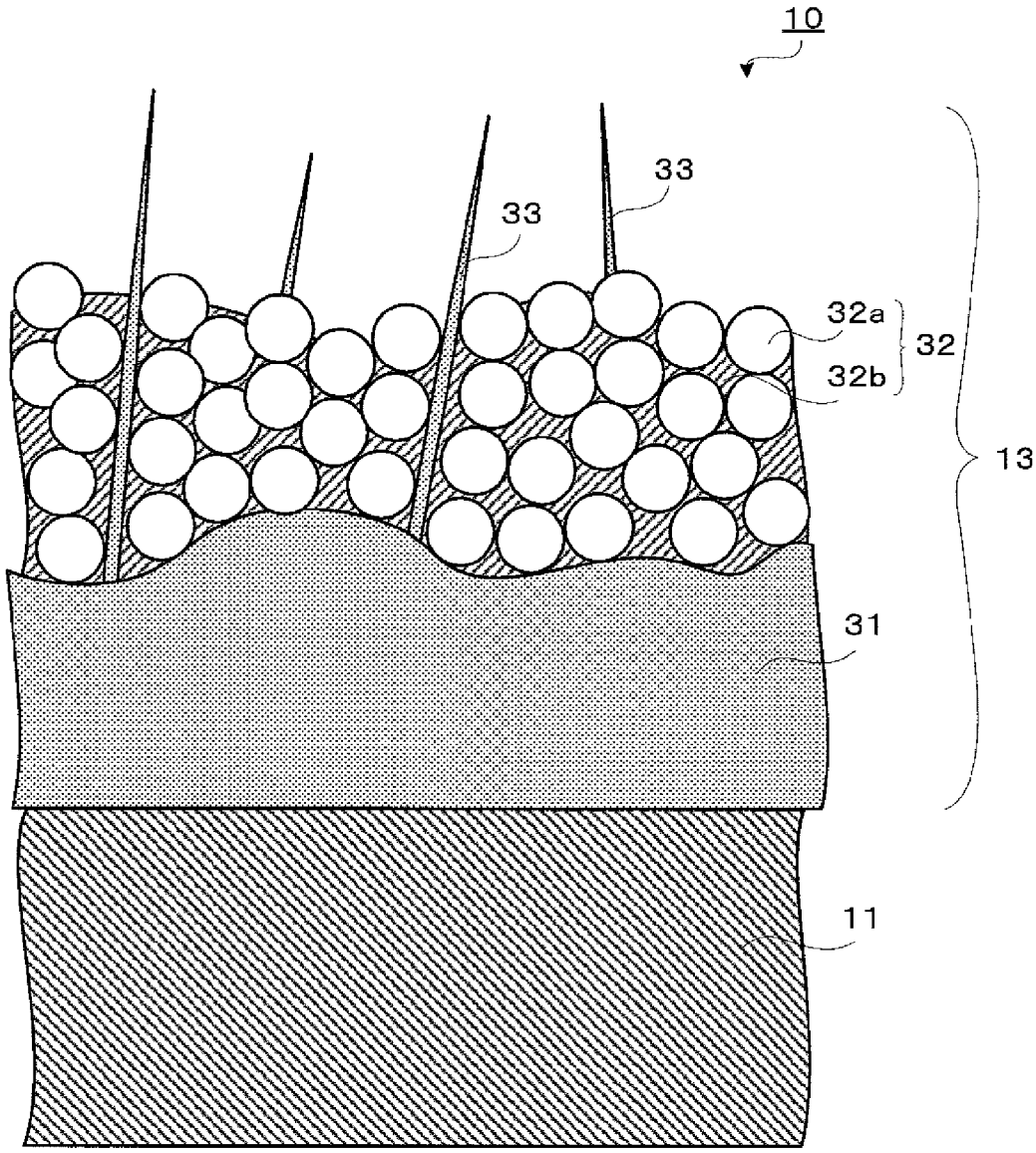
FIG. 1 is a cross-sectional view schematically showing a field emission electrode of embodiments of the present invention.

First, a description is given using the drawings of a field emission electrode 10 made using the method of manufacturing a field emission electrode of the embodiment of the present invention. FIG. 1 is a cross-sectional view schematically showing the field emission electrode 10.

The field emission electrode 10 has a conductive substrate 11, and an electron emission film 13, as shown in FIG. 1. Further, in this embodiment, the electron emission film 13 includes a carbon nanowall (Carbon Nano Wall; hereinafter abbreviated to "CNW") 31 with a plurality of graphite structure carbon flakes forming curved petal shapes (fan shapes) standing up connected in random directions, a microcrystal diamond film (carbon film) 32 that is a layer including a plurality of microcrystal diamonds with particle diameters of an order of nanometers (1 μm less) stacked up consecutively on the CNW 31, and needle-shaped carbon rods 33 mainly grown from parts of the CNW 31, passing through gaps in the microcrystal diamond film 32, and projecting outwards from a surface of the microcrystal diamond film 32. Further, electron emission characteristics of the electron emission film 13 are improved by conditioning process described later performed directly after film forming so that electrons are emitted in a comparatively uniform manner over the whole of the film. The microcrystal diamond film 32 includes a plurality of accumulated diamond particles 32*a* and phases 32*b* where sp2 bonds are dominant interposed between the diamond particles 32*a*. The needle-shaped carbon rods 33 are not hollow as with carbon nanotubes, but rather are packed with an internal core and are mechanically strong.

Figure 2:
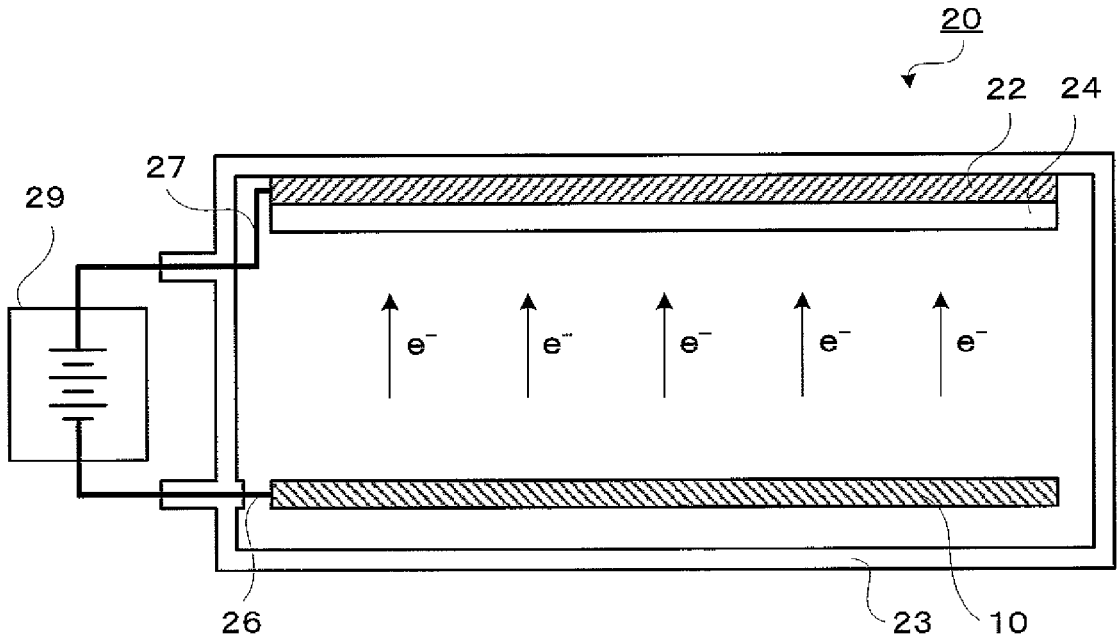
FIG. 2 is a outline cross-sectional view showing an example structure for electronic device equipped with the field emission electrode of the embodiments of the present invention.

The field emission electrode 10 of this embodiment can be used in electronic equipment such as a field emission fluorescent tube 20 as shown, for example, in FIG. 2. As shown in FIG. 2, the field emission fluorescent tube 20 is equipped with the field emission electrode 10 (cathode electrode) having an electron emission film, an anode 22 provided facing the field emission electrode 10, a glass tube 23 sealing the cathode and the anode 22 in a vacuum atmosphere, and a fluorescent film 24 provided at a surface facing the field emission electrode 10 of the anode 22. Wiring 26 such as Kovar is connected to the substrate 11 of the field emission electrode 10 and wiring 27 such as Kovar is connected to the anode 22. The field emission electrode 10 (cathode electrode) and the anode 22 are connected to a high-voltage drive supply 29.

Figure 3:
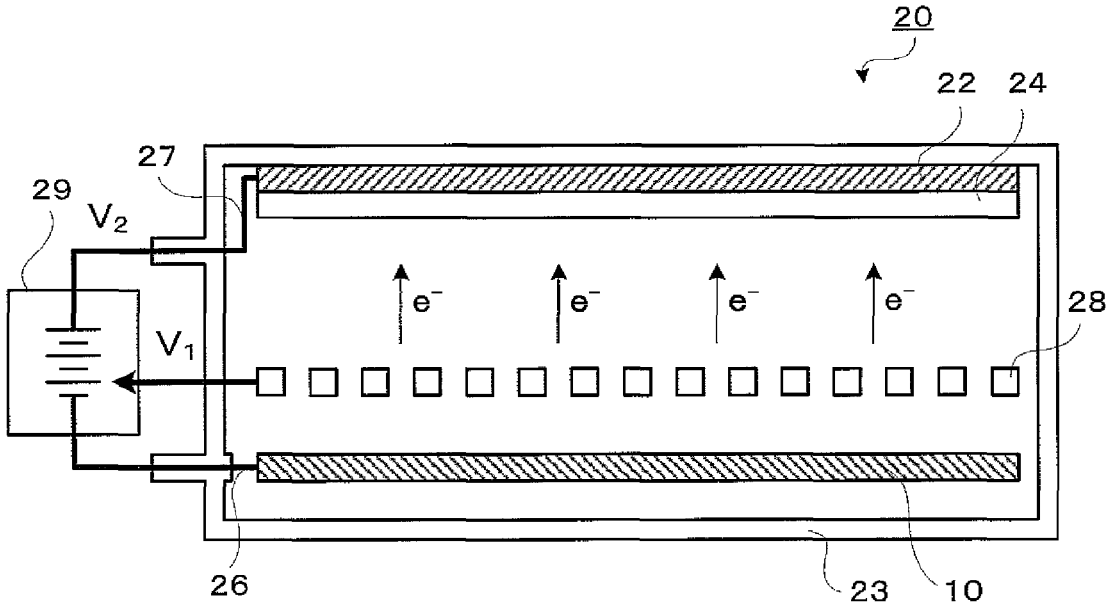
FIG. 3 is an outline cross-sectional view showing a modified example of electronic equipment of the embodiments of the present invention.

Further, the field emission fluorescent tube 20 is not limited to the two electrode-type shown in FIG. 2. A three-electrode type where a grid electrode 28 for performing control to draw out or stop electrons is also possible, as shown in FIG. 3. A variable voltage V1 is then applied to the grid electrode 28 so as to regulate the quantity of electrons emitted from the field emission electrode 10 and a fixed voltage V2 appropriate for the fluorescent film 24 is applied between the anode 22 and the field emission electrode 10.

Next, an explanation is given using the drawings of a method of manufacturing the field emission electrode of this embodiment.

First, the substrate 11 is prepared, and the surface of the substrate 11 is degreased and ultrasonically cleaned sufficiently using ethanol or acetone.

A conductive material including at least a semiconductor, a metal, or a metalloid such as, for example, a substrate of Si, Mo, Ni, or a stainless alloy can be used as the substrate 11. The metal or metalloid may be included in the whole of the substrate 11 or may be formed only at the side of the surface where the electron emission film 13 is formed. The electron emission film 13 is formed on the substrate 11 as shown in FIG. 1. The electron emission film 13 is formed by a plasma CVD (Chemical Vapor Deposition) apparatus. It is therefore preferable for the substrate 11 to have a melting point greater than the film-forming temperature, preferably 800 degrees centigrade or more, or still more preferably 1000 degrees centigrade or more. It is also preferable for the material used for the wiring 26 and wiring 27 to have substantially the same thermal expansion coefficient as that of soda glass used for the glass tube 23 such as, with it being preferable to use, for example, a 42Ni alloy.

Next, the electron emission film 13 is formed on the substrate 11. The electron emission film is formed by a direct current plasma CVD apparatus. An example structure for a direct current plasma CVD apparatus 100 is shown in FIG. 4A and FIG. 4B and a graph showing change in temperature of the substrate when film-forming is shown in FIG. 5.

Figure 4A:
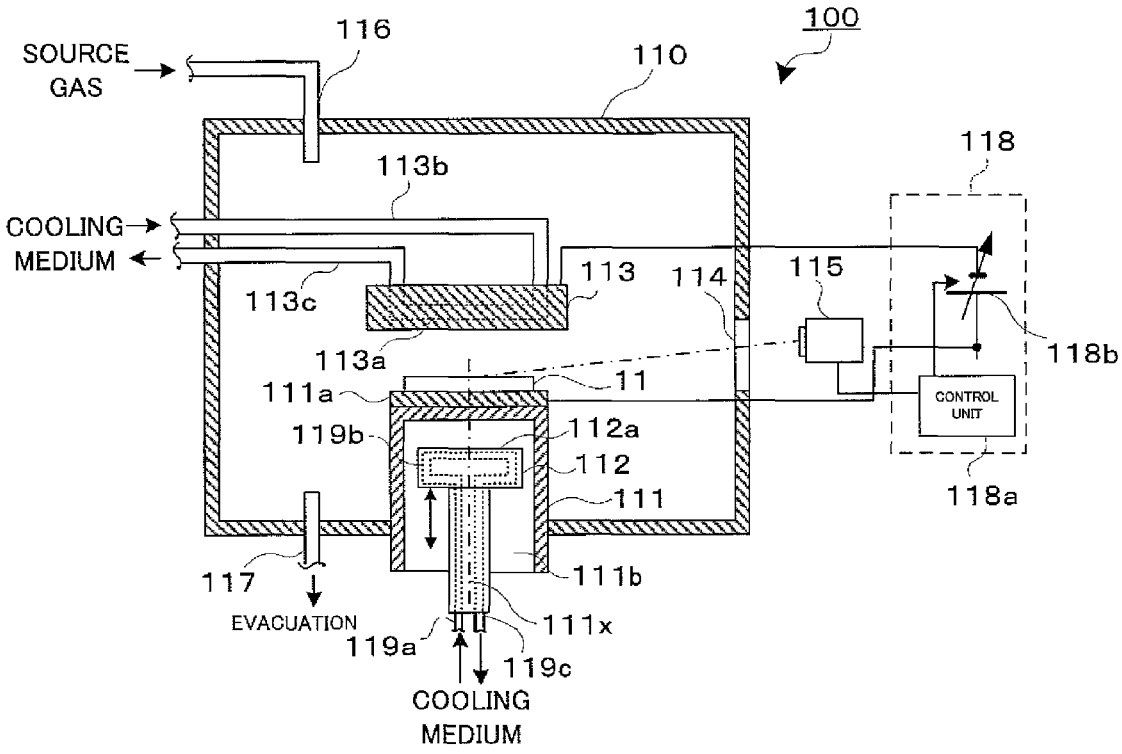
FIG. 4A and FIG. 4B are diagrams showing example structures for CVD apparatus of the embodiments of the present invention.
Figure 4B:
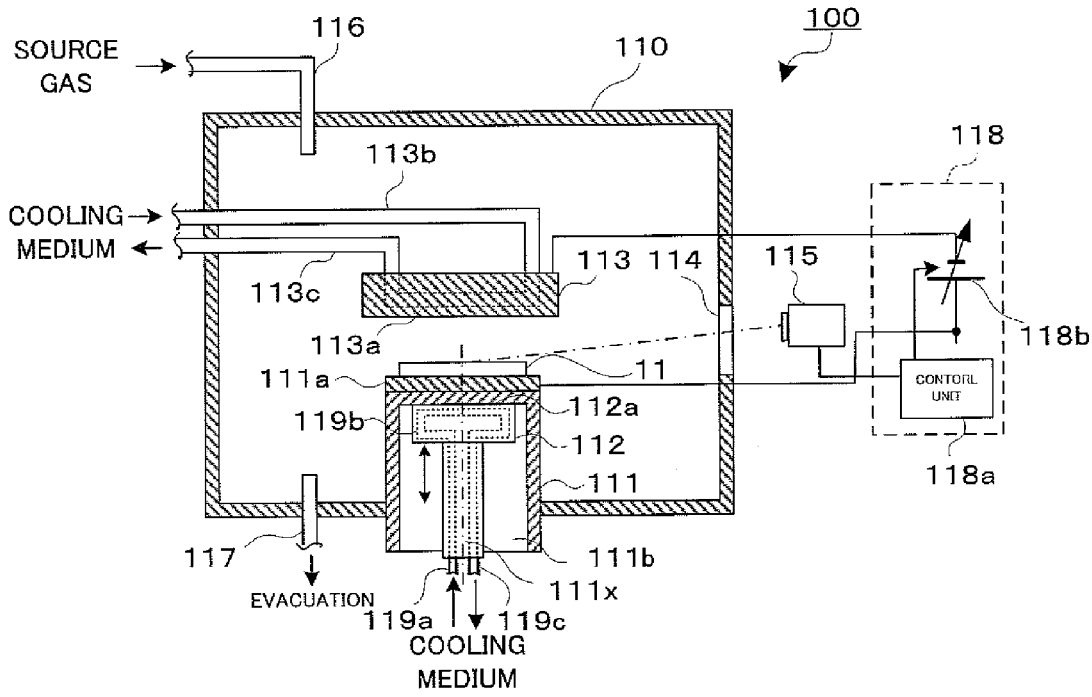
Figure 5:
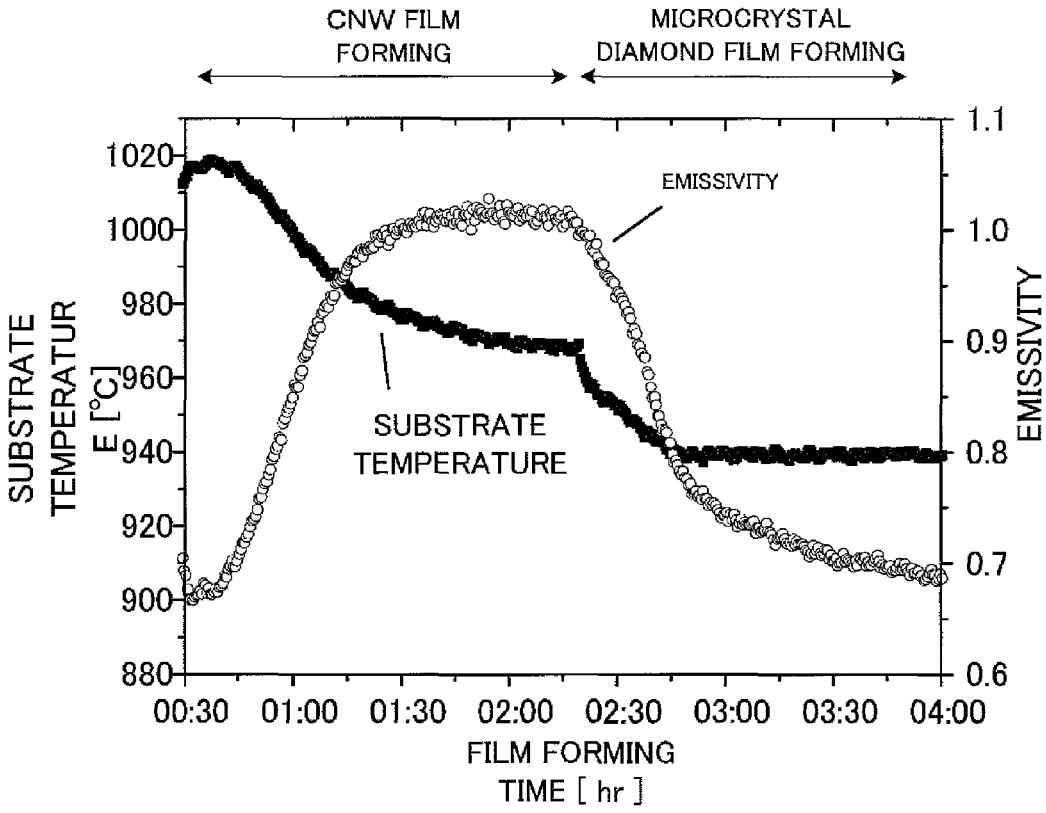
FIG. 5 is a graph showing temperature change while forming an electron emission film.

The direct current plasma CVD apparatus 100 shown in FIG. 4A and FIG. 4B is equipped with a chamber 110, a stage 111, an anode 111*a*, a cooling member 112, a cathode 113, a flow path 113*a*, conduits 113*b* and 113*c*, a window 114, a spectrophotometer 115, a gas conduit 116, an evacuation pipe 117, an output setting unit 118, a control unit 118*a*, conduits 119*a*, 119*b*, and 119*c*, a radiance meter (not shown), and a thermocouple for measuring the temperature of the substrate 11.

The chamber 110 blocks the substrate 11 off from the open air outside the chamber 110. The stage 111 made of steel is disposed within the chamber 110. The disc-shaped anode 111*a* made of a metal with good thermal conductivity and a high melting point (molybdenum etc.) is fitted to an upper part of the stage 111. The substrate 11 is fixed at a mounting surface on the upper side of the anode 111*a*. The stage 111 is set so as to be capable of rotating together with the anode 111*a* and is centered about an axis 111*x*.

A closed space 111*b* is provided at a lower side of the anode 111*a*. The cooling member 112 is disposed at the space 111*b*. The cooling member 112 can then be moved freely up and down as shown by the arrows by a moving mechanism (not shown). The cooling member 112 is formed of a metal with a high thermal conductance such as copper. A coolant such as cooled water or cooled calcium chloride solution flows from the conduit 119*a* to the flow path 119*b* within the cooling member 112 and is discharged from the conduit 119*c* so as to circulate and keep the whole of the cooling member 112 cooled. When a surface 112*a* of the cooling member 112 approaches or abuts with the lower surface of the stage 111 as shown in FIG. 4B as a result of the cooling member 112 moving upwards, the thermal resistance between the cooling member 112 and the stage 111 is reduced and the stage 111 is cooled. As a result, the anode 111*a* positioned on an upper part is cooled indirectly and the anode 111*a* dissipates the heat of the substrate 11.

The cathode 113 is disposed above the anode 111*a* at a fixed distance facing the anode 111*a*. The flow path 113*a* that the coolant flows through is formed within the cathode 113 with conduits 113*b*, 113*c* being fitted to both ends of this flow path 113*a*. The conduits 113*b* and 113*c* pass through holes formed in the chamber 110 and communicate with the flow path 113*a*. Coolant such as water or calcium chloride solution then flows through the conduit 113*b*, the flow path 113*a*, and the conduit 113*c* so as to suppress heat generated by the cathode 113.

The window 114 fitted with heat-resistant glass is formed at a side surface of the chamber 110. The spectrophotometer 115 that measures the temperature of the substrate 11 via the glass of the window 114 is then disposed outside of the chamber 110.

The direct current plasma CVD apparatus 100 is equipped with a raw material supply system apparatus (not shown) that introduces source gas via the gas conduit 116, an evacuation system apparatus (not shown) that evacuates gas from within the chamber 110 via the evacuation pipe 117 and regulates the atmospheric pressure within the chamber 110, and the output setting unit 118.

The radiance meter measures radiance due to heat radiation from the surface where the electron emission film 13 of the substrate 11 grows from the window (not shown). The spectrophotometer 115 measures spectral luminance of light emitted from the window 114.

The output setting unit 118 is a control unit for setting a voltage or current between the anode 111*a* and the cathode 113 and is equipped with the control unit 118*a* and a variable supply 118*b*. The control unit 118*a* calculates an exact temperature for the substrate 11 by carrying out pre-programmed operations based on spectral data information measured by the spectrophotometer 115 and adjusts the voltage or current between the anode 111*a* and the cathode 113 so that the temperature of the substrate 11 becomes a preset value. Specifically, the control unit 118*a* measures in advance a plasma emission spectrum for when the radiance due to heat radiation from the substrate 11 heated in a plasma atmosphere is less than the measurement error of the radiance meter. A wavelength region of the measured spectrum where the radiance ratio of each wavelength does not change even if the plasma induction power is changed is then selected. An equation linearly combining a Planck radiation equation relating to the substrate 11 or an approximation equation thereof and a spectrum is then subjected to fitting to a spectrum where heat radiation of the substrate 11 and plasma emissions are superimposed in the selected wavelength region using the non-linear least-square method. The temperature of the substrate 11 is then calculated based on the fitting during heating processing of the substrate 11.

The substrate 11 is then mounted on the anode 112*a* of the CVD apparatus. Next, the substrate 11 is mounted on the anode 111*a* of the direct current plasma CVD apparatus 100. When mounting of the substrate 11 is complete, the pressure is reduced within the chamber 110 using the evacuation system apparatus. Hydrogen gas and a compound gas (carbon-containing compound) containing carbon during composition such as methane are guided from the gas conduit 116.

A range of 3 volume % to 30 volume % is preferable for the compound gas containing carbon in composition in the source gas. For example, the flow rate for methane is 50 SCCM, the flow rate for hydrogen is 500 SCCM, and the overall pressure is 0.05 to 1.5 atm, or preferably 0.07 to 0.1 atm. Further, the anode 111*a* is rotated at 10 rpm each substrate 11, a direct current is applied across the anode 111*a* and the cathode 113 so that variation in temperature on the substrate 11 is within 5%, a plasma is generated, and the plasma state and the temperature of the substrate 11 are controlled.

FIG. 5 is a graph of a plot of emissivity calculated from the heat radiation spectrum emitted from the surface of the substrate 11 and the surface temperature of the substrate 11 versus film-forming time. As shown in FIG. 5, film-forming is carried out with the temperature of the location where the CNW 31 of the substrate 11 is formed maintained at from 960 degrees centigrade to 1100 degrees centigrade for a film-forming time of up to approximately 2 hours. This temperature is measured by the spectrophotometer 115. At this time, the cooling member 112 is spaced sufficiently far away as to not influence the temperature of the anode 111*a*. Evaluation of the emissivity and temperature of the substrate are obtained only from the heat radiation at the substrate 11 side surface in such a manner that the spectrum for the plasma radiation of the direct current plasma CVD apparatus 100 is subtracted from the spectrum measured by the spectrophotometer 115.

When the CNW 31 constituting a foundation is formed to a sufficient film thickness on the substrate 11, continuing as is without changing the gas atmosphere, the cooling member 112 of a much lower temperature than the anode 111*a* heated by the plasma is raised so as to be close to or abut with the stage 111, and the anode 111*a* is cooled. At this time, the anode 111*a* cools the substrate 11 fixed on the anode 111*a*. As shown in FIG. 5, the surface on the substrate 11-side is then rapidly cooled to ten degrees centigrade or more lower than at the time of forming the CNW 31 to a temperature appropriate for forming a plurality of the diamond particles 32*a*. The temperature at this time is 890 degrees centigrade to 950 degrees centigrade, or more preferably 920 degrees centigrade to 940 degrees centigrade. In order to ensure that the temperature is stable thereafter, it is preferable not to change the voltage or current applied to the anode 11*a* or to the field emission electrode 10 that is the cathode during cooling.

When growth of the CNW 31 is suppressed because the substrate 11 is cooled a plurality of diamond particles 32*a* of particle diameters of 5 to 10 nanometers starts to grow on the CNW 31. Before long, growth of the diamond particles 32*a* becomes dominant rather than growth of the CNW 31. When the microcrystal diamond film 32 is formed as a result of a massive body of the diamond particles 32*a* forming a layer structure, the needle-shaped carbon rods 33 where the surface of the CNW 31 transforms grow in spaces positioned between regions where the massive bodies of the diamond particles 32*a*, i.e. between massive bodies of the diamond particles 32*a* as shown in FIG. 1. The ends of the needle-shaped carbon rods 33 are then formed so as to project from the surface of the microcrystal diamond film 32. The outbreak points of the CNW 31 are mainly on the surface of the CNW 31 but occurrences from other points are also possible. However, the needle-shaped carbon rods 33 growing from the CNW 31 as described later are mechanically strong as a result of having a graphite layer core on the inside and having a needle-shaped structure upon which the electrical field can easily focus. It is therefore possible to achieve stable electron emissions from the ends of the needle-shaped carbon rods 33.

In the end stage of film-forming, application of a voltage between the anode 111*a* and the cathode 113 is stopped. Supply of source gas is stopped. Nitrogen gas is then supplied as purge gas to within the chamber 110 and the pressure is returned to normal pressure. The substrate 11 is then extracted in a state where normal temperature is returned to.

Further, the electron emission film 13 formed in this way has the CNW 31 with a plurality of graphite structure carbon flakes forming curved petal shapes (fan shapes) as shown schematically in FIG. 1 standing up and connected in random directions, the microcrystal diamond film (carbon film) 32 that is a layer including a plurality of microcrystal diamonds stacked up consecutively on the CNW 31, and needle-shaped carbon rods 33 projecting outwards from a surface of the microcrystal diamond film 32.

Figure 6:
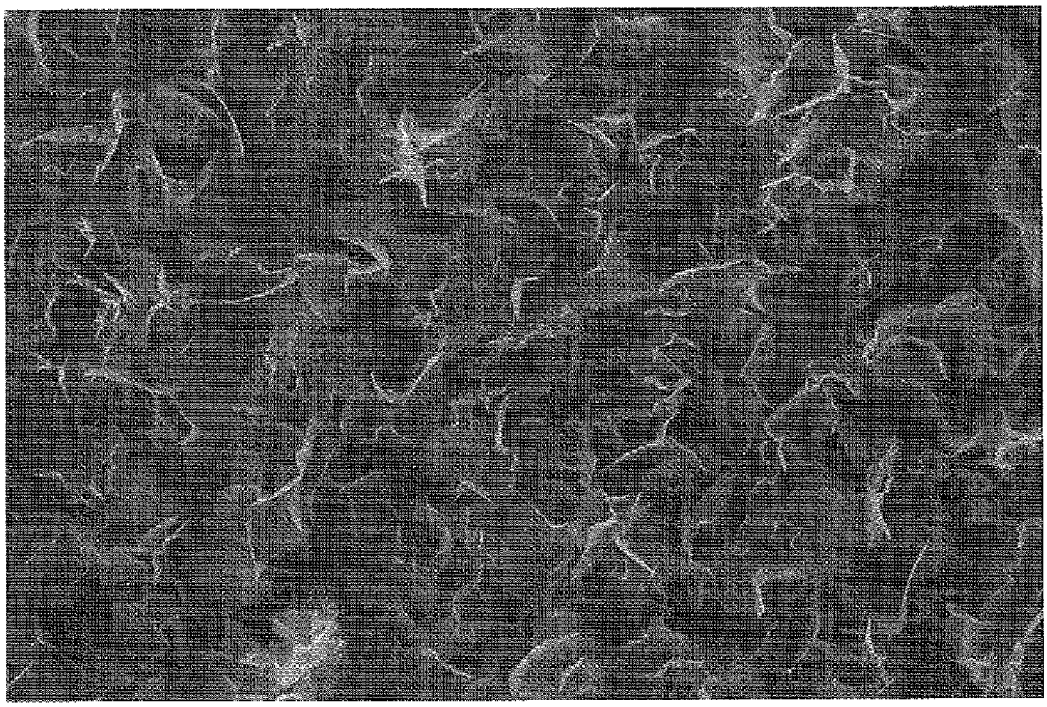
FIG. 6 is an image of a surface of a carbon nanowall scanned by a scanning electron microscope.
Figure 7:
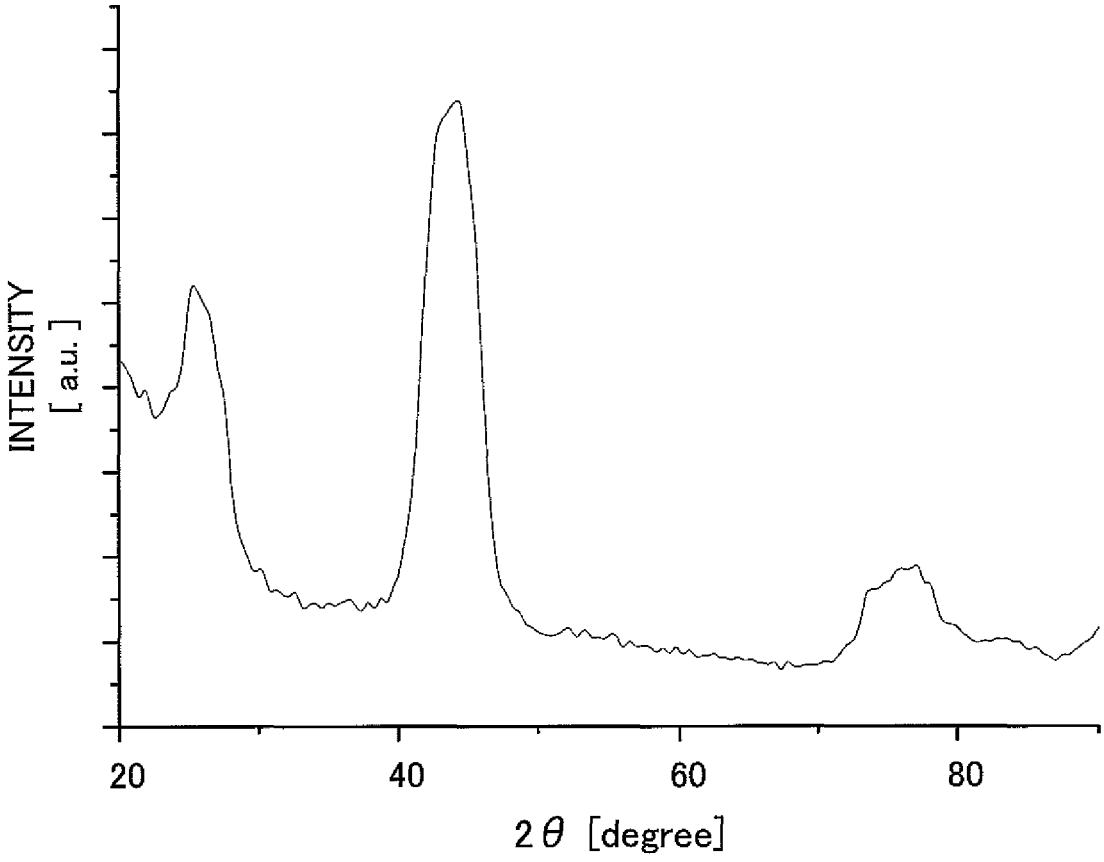
FIG. 7 is a view showing an X-ray diffraction pattern for a carbon nanowall.
Figure 8:
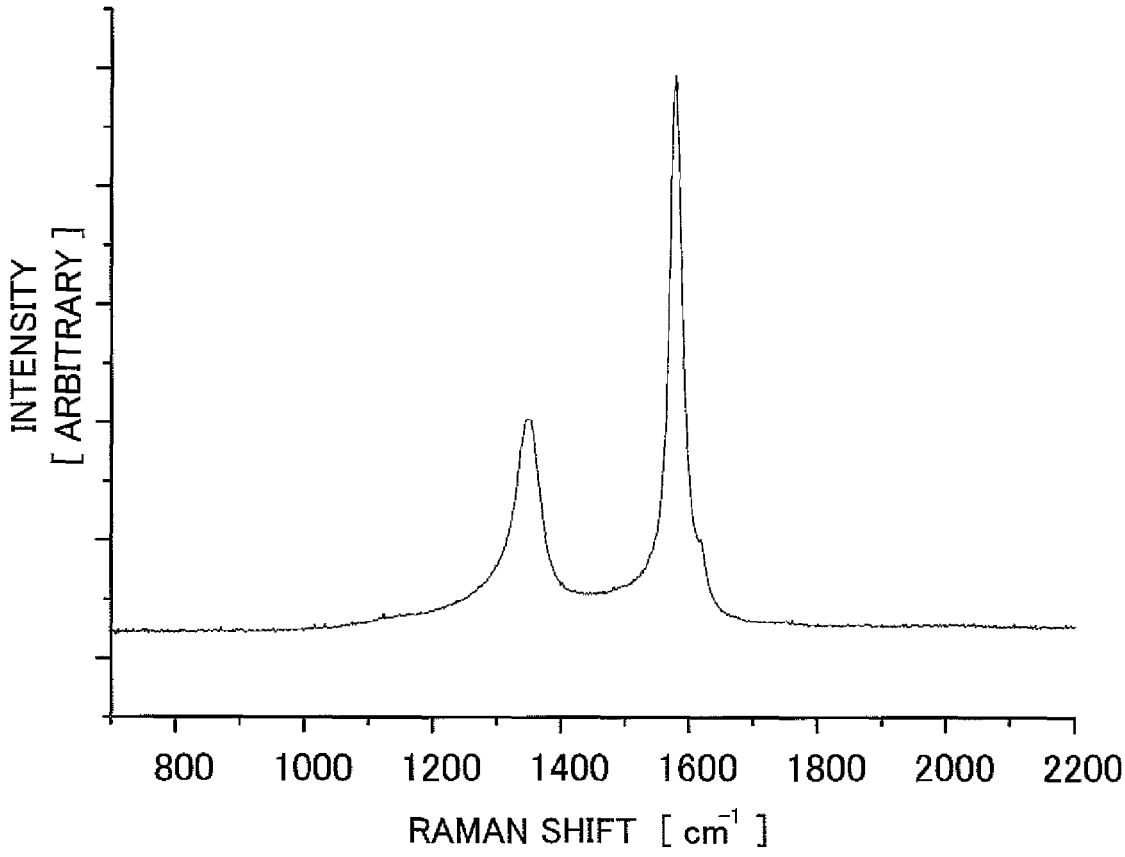
FIG. 8 is a view showing a Raman spectrum for a carbon nanowall.

An image of the surface of the CNW 31 before the microcrystal diamond film 32 is formed (the surface corresponding to the boundary surface of the CNW 31 and the microcrystal diamond film 32 shown in FIG. 1) scanned using a scanning electron microscope is shown in FIG. 6. Further, an X-ray diffraction pattern for the CNW 31 is shown in FIG. 7, and a Raman spectrum due to laser light of wavelength 532 nanometers is shown in FIG. 8. As shown in FIG. 6, the CNW 31 has a plurality of carbon flakes forming curved petal shapes (fan shapes) standing up connected in random directions. CNW 31 is 0.1 nanometers to 10 micrometers thick. The surface of the graphite can be confirmed from the X-ray diffraction pattern shown in FIG. 7. It can also be understood that the CNW 31 has sp2 bonds from the Raman spectrum shown in FIG. 8. The carbon flakes of the CNW 31 can be said to be comprised of fine, high-purity sp2 graphite bonds because peaks other than a G-band peak where a half-width caused by vibration of carbon atoms within a hexagonal lattice of carbon-carbon bonds for graphite in the vicinity of 1580 $cm^{-1}$ is less than 50 $cm^{-1}$ and peaks other than a D-band peak that can be seen in graphite accompanying lattice defects in the vicinity of 1350 $cm^{-1}$ can substantially not be seen. As a result, it can be understood that each carbon flake of the CNW 31 includes a few layers to a few tens of layers of graphene sheets of a grid interval of 0.34 nanometers. The graphene sheets have sp2 bonds and exhibit conductivity. The CNW 31 therefore also exhibits conductivity.

As shown schematically in FIG. 1, the needle-shaped carbon rods 33 are grown from the CNW 31. Further, the diamond particles 32*a* of the microcrystal diamond film 32 are disposed about the peripheries of the needle-shaped carbon rods 33. The needle-shaped carbon rods 33 and the CNW 31 are therefore continuous as a result of the needle-shaped carbon rods 33 being grown from the CNW 31. Electrons can therefore be supplied effectively from the CNW 31 that is a conductor to the needle-shaped carbon rods 33 and superior emission of electrons from the needle-shaped carbon rods 33 can be achieved.

Figure 9:
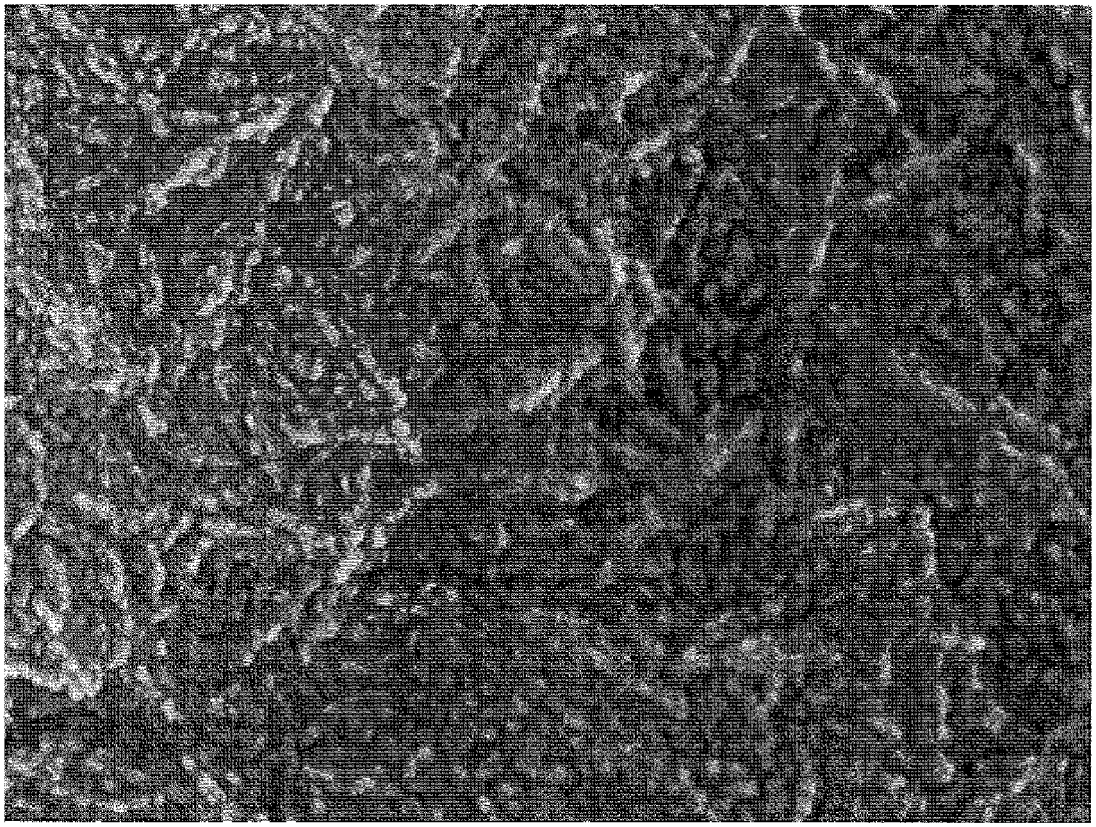
FIG. 9 is an image of the surface of a nanodiamond film (carbon film) scanned by a scanning electron microscope.
Figure 10:
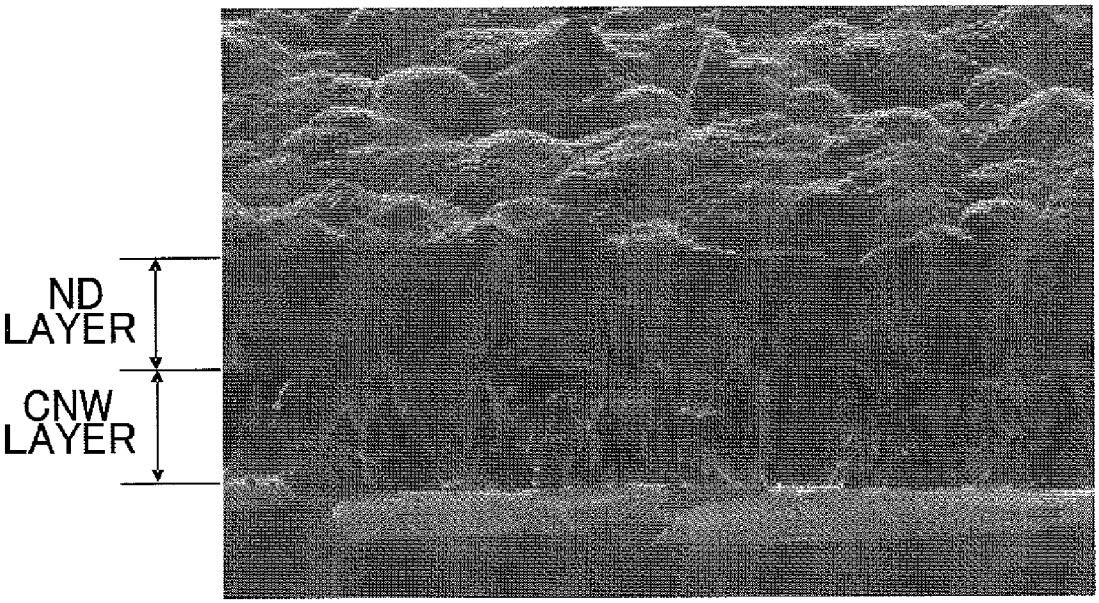
FIG. 10 is an image of a cross-section of a nanodiamond film (carbon film) scanned by a scanning electron microscope.
Figure 11:
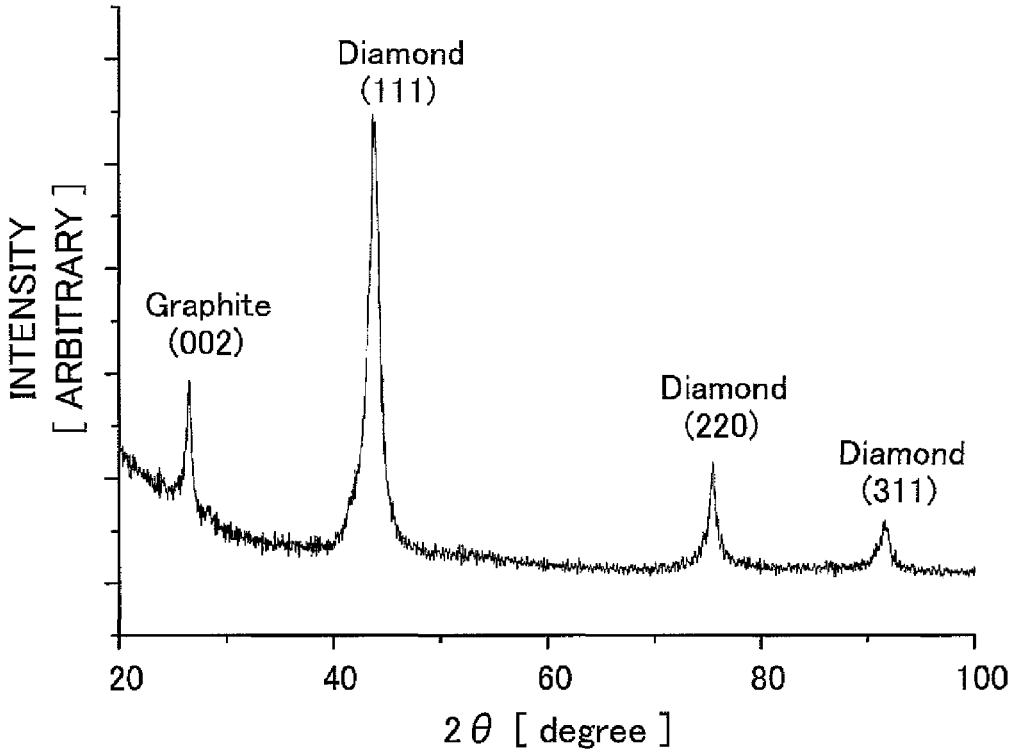
FIG. 11 is a view showing an X-ray diffraction pattern for a nanodiamond film.
Figure 12:
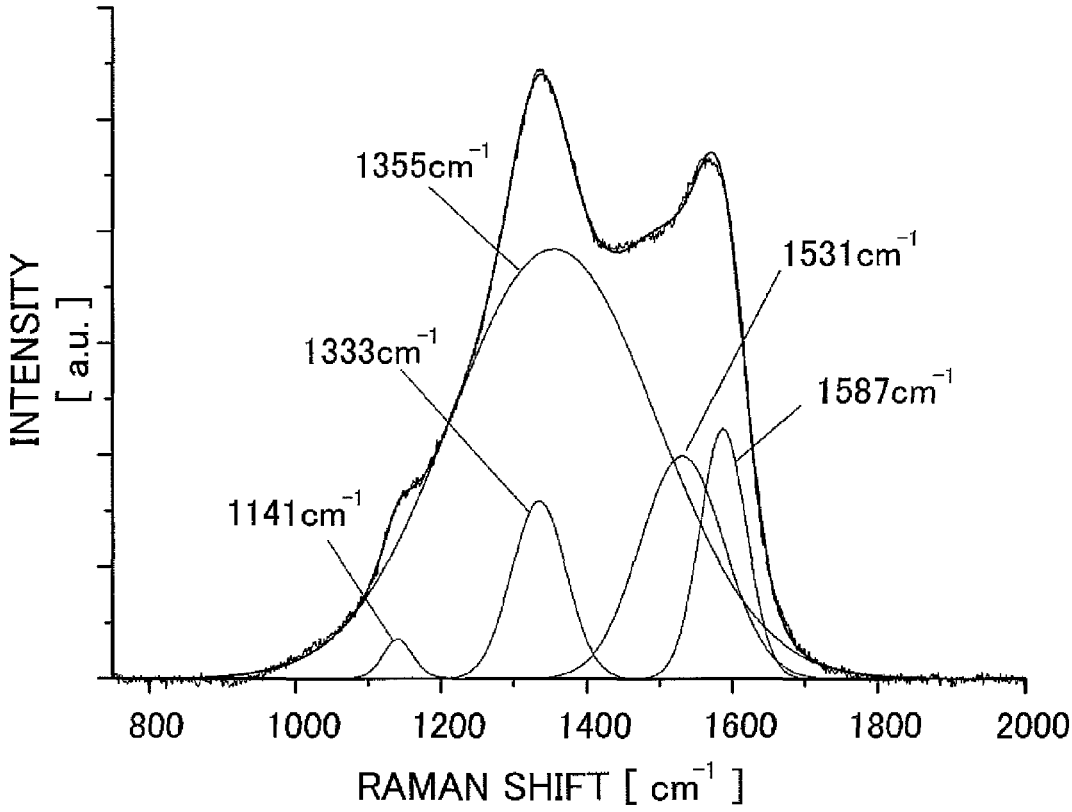
FIG. 12 is a view showing a Raman spectrum for a nanodiamond film.

Next, an image of the surface of the microcrystal diamond film (carbon film) 32 scanned from an upper surface by a scanning electron microscope is shown in FIG. 9 and an image scanned of a cross-section is shown in FIG. 10. Further, an X-ray diffraction pattern for a microcrystal diamond film 32 formed on the CNW 31 is shown in FIG. 11 and a Raman spectrum due to laser light of a wavelength of 532 nanometers is shown in FIG. 12. As is described in detail later, rather than being just pure graphite and diamond particles, the microcrystal diamond film 32 can also be confirmed as having an intermediate phase having both sp2 and sp3 bonds and is a film having a complex of these. Although strictly speaking it is therefore accurate to refer to this film as a carbon film, the film is referred to as a microcrystal diamond film for the convenience of explanation.

The microcrystal diamond film 32 has a layer structure including a plurality of sp3 bond diamond particles of particle diameters of 5 nanometers to 10 nanometers. A few tens to a few hundreds of diamond particles are assembled on the surface as shown in FIG. 9 so as to form an organization appearing as bamboo leaves. A plurality of bamboo leaf-like structures are collected at the surface at the microcrystal diamond film 32 as shown in FIG. 9 and FIG. 10. A plurality of massive bodies are then densely packed at the surface so as to cover the CNW 31, as shown schematically in FIG. 1. The diameters of the massive bodies of the microcrystal diamond film 32 are in the order of 1 micrometer to 5 micrometers and are preferably grown to an extent covering the CNW 31. The surface of the microcrystal diamond film 32 has fewer undulations than the surface of the CNW 31 constituting the foundation and is comparatively smooth. Gaps are formed between the boundary surfaces (grain boundaries) of each massive body of the microcrystal diamond film 32 as shown in the drawings. As described in the following, in a process of growing the microcrystal diamond film 32, the microcrystal diamond film 32 constitutes a solid body impediment. Stress is therefore applied to the CNW 31 as the microcrystal diamond film 32 attempts to continue to grow. As a result, parts of the CNW 31 grow in the shape of needles, so as to give needle-shaped carbon rods 33 projecting from the spaces. This has the effect that growth of the CNW 31 degenerates in the gaps between the microcrystal diamond film 32 and the massive bodies of the microcrystal diamond film 32 and a large quantity of needle-shaped carbon rods 33 are formed.

When an X-ray diffraction pattern occurring at the microcrystal diamond film 32 is investigated, as shown in FIG. 11, a marked peak exists for the diamond crystals. The kind of sharp peak cannot be seen in a non-crystalline phase such as diamond-like carbon so manufacture using crystalline diamond can be confirmed. Slight graphite peaks can also be observed for the X-ray diffraction pattern in addition to the diamond peaks. This means that not only diamond but also crystalline graphite such as the needle-shaped carbon rods 33 and the phases 32*b* where the sp2 bonds are dominant also exist at the main surface of the microcrystal diamond film 32. The surface of the microcrystal diamond film 32 is therefore not a perfect insulator, but rather exhibits conductivity to the extent that the needle-shaped carbon rods 33 conduct. Superior electron emission characteristics can therefore be discerned.

FIG. 12 shows Raman spectrum measurements taken using laser light of a wavelength of 532 nanometers. The spectrum shown by the solid line is an aggregate of the plurality of diamond particles 32*a* of the microcrystal diamond film 32 and a portion from 750 $cm^{-1}$ to 2000 $cm^{-1}$ of the Raman spectrum for the phases 32*b* where the sp2 bond is dominant, with numerical values for a baseline portion excluded from a spectrum taking a line linking the vicinity of the extracted ends as a baseline.

Next, initial values for positions of 1140 $cm^{-1}$, 1330 $cm^{-1}$, 1333 $cm^{-1}$, 1520 $cm^{-1}$, and 1580 $cm^{-1}$ are substituted in a pseudo-Voigt function. A profile where peaks are superimposed is then fitted with the measured spectrum using the non-linear least square method having a degree of freedom for each peak position, peak height, and line width. As a result, as shown in FIG. 12, a profile substantially matching with the measured spectrum can then be obtained.

Here, a signal that could not be seen can now be seen in a CNW signal in the vicinity of 1140 $cm^{-1}$. With peaks that can be seen in diamond synthesized using CVD etc., the bond angle and bond length for C—C has a structure close to sp3 and a peak deriving from a phase where the crystal (or cluster) is of a nano-order size can be seen. Further, it can also be suggested from FIG. 12 that a peak also exists at 1333 $cm^{-1}$ although this is concealed by the broad line width D-band peak (1355 $cm^{-1}$) for the graphite. In Raman spectrum measurements using visible light, this can be considered to be a peak derived from diamond that only has 1/20 or less sensitivity compared to graphite. It can therefore be considered that the Raman spectrum of FIG. 12 is caused by the film 32 composed of crystallized diamond particles in which the diamond composition is dominant.

The electron emission film 13 having this kind of characteristic exerts influence on the electron emission characteristics due to the film-forming characteristics for intensity of the active species etc. due to the plasma of the direct current plasma CVD apparatus 100. After forming the electron emission film 13 in order to improve variation in the electron emission characteristics, conditioning is carried out. Conditioning is comprised of aging processing occurring in a humidified state and baking processing.

Figure 13:
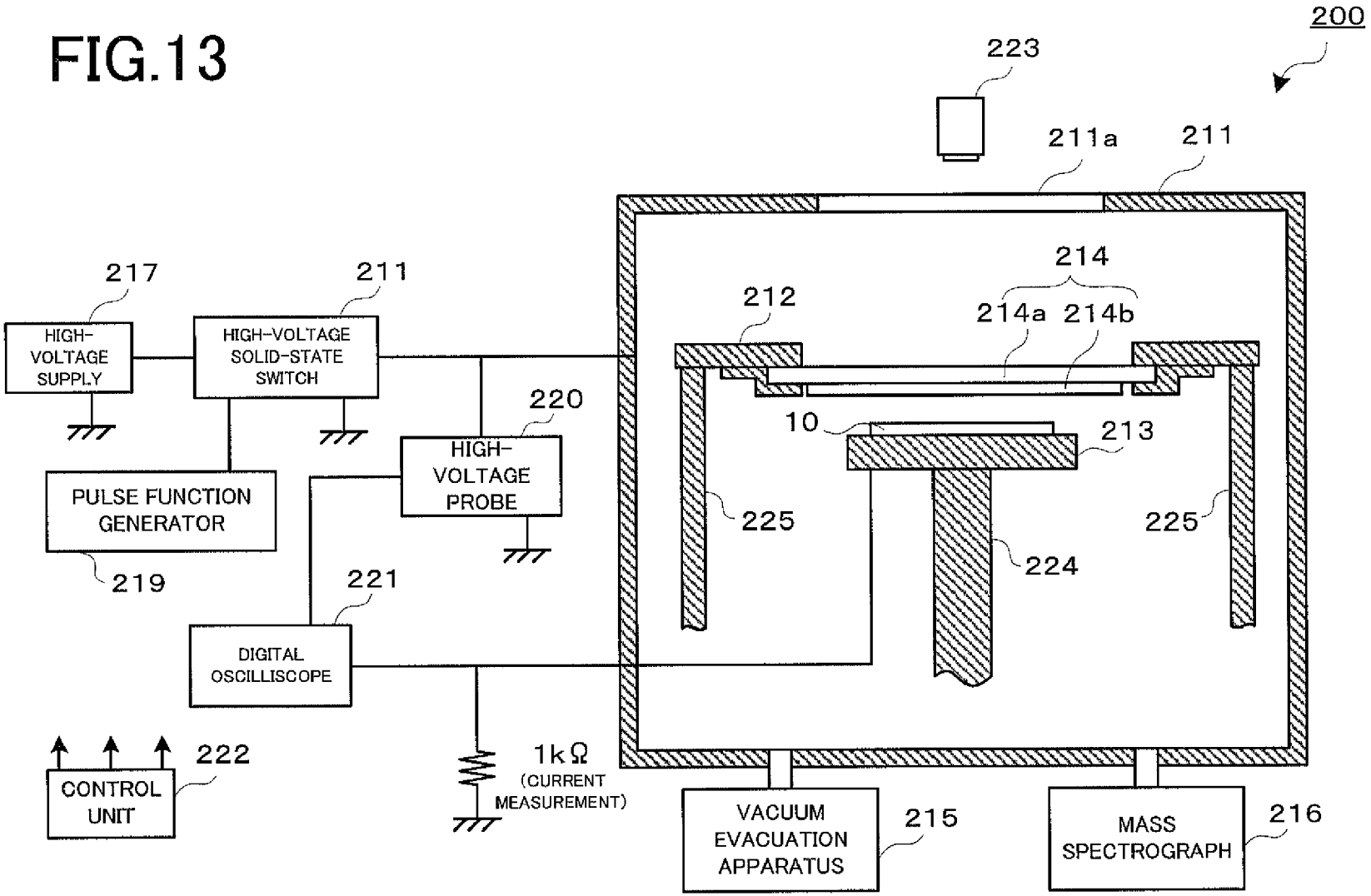
FIG. 13 is a view showing an example structure for processing apparatus of the embodiments of the present invention.

First, aging processing is carried out in a humidified state using a processing apparatus 200 shown in FIG. 13.

As shown in FIG. 13, the processing apparatus 200 is equipped with a vacuum chamber 211, a conductive anode support section 212, a conductive mounting table (cathode) 213, an anode 214 supported at the anode support section 212, a vacuum evacuation apparatus 215, a mass spectrograph 216, a high-voltage supply 217, a high-voltage solid state switch 218, a pulse function generator 219, a high-voltage probe 220, a digital oscilloscope 221, a control unit 222, image-capturing apparatus 223 such as a video camera, a support column 224 that supports the conductive mounting table 213, and a support column 225 that supports the anode support section 212. The distance between the field emission electrode 10 on the conductive mounting table 213 and the anode 214 is set to 4.3 millimeters. The support column 224 is equipped with an insulator such as an alumina insulator for ensuring that the conductive mounting table 213 does not conduct with the floor within the vacuum chamber 211. The support column 225 is also equipped with an insulator such as an alumina insulator for ensuring that the anode support section 212 does not conduct with the floor within the vacuum chamber 211.

The anode 214 facing the conductive mounting table 213 that the field emission electrode 10 is mounted on is disposed within the vacuum chamber 211. It is preferable for at least the surface of the anode 214 facing the conductive mounting table 213 to be hydrophilic. By making the surface of the anode 214 hydrophilic, water molecules desorbed from the electron emission film 13 of the field emission electrode 10 in aging processing described in detail later can be temporarily absorbed by the anode 214 and abrupt changes in the partial pressure of the water vapor between the electrodes can be made more lenient. As shown in FIG. 13, by making the anode 214 a fluorescence board such as, for example, a board where a fluorescent substance 214*b* having a hydrophilic surface is applied to a glass plate 214*a* provided with a transparent conductive film such as ITO on the surface of the side where the ITO is formed, it is possible to observe electron emission distribution of the electron emission element surface from the fluorescent state of the fluorescent substance 214*b* at the image-capturing apparatus 223 in the aging process. Further, the surface of the anode 214 gradually becomes contaminated as a result of carbon content (or clusters) etc. from the electron emission film 13 generated in the aging process. This contamination can removed by combustion through heating to a temperature of 400 degrees centigrade or more in the atmosphere. It is therefore preferable for the material of the anode to be resistant to heating to 400 degrees centigrade in the atmosphere.

Further, in the aging processing, the peak voltage applied to the field emission electrode or between the conductive mounting table 213 and the anode 214 and the duty ratio can be arbitrarily changed using the high-voltage supply 217, the high-voltage solid state switch 218, and the pulse function generator 219. Here, the duty ratio is the ratio of on time per unit time of the high-voltage solid state switch 218. In the aging processing, the voltage applied to the field emission electrode and the anode and the current flowing through the field emission electrode are measured at the same time. As a result, electron emission is carried out intermittently by applying a fixed field intensity (applied voltage/distance between electrodes) periodically for a fixed period of time and aging is carried out. During this time, aging is carried out while successively evaluating the electron emission quantity changing in a pulsating manner and the voltage using measuring means such as an oscilloscope. Aging is then ended at a time where change in electron emission density converges.

First, the field emission electrode 10 is then exposed for the order of 1 minute to a high humidity environment of, for example, a room temperature of approximately 25 degrees centigrade and a humidity of 100%. The field emission electrode 10 is then dried for approximately 10 minutes at a humidity of 50%. The humidity of the humid atmosphere is not limited to 100% but is preferably 80% or more. The humidification time is also not limited to 1 minute, and can be less than 1 minute or longer than 1 minute providing that sufficient humidification is achieved. The surface of the electron emission film 13 of the field emission electrode is hydrophobic and moisture can be made to evaporate in accordance with changes in humidity of the environment. Part of the moisture that is most at the surface of the electron emission film 13 remains absorbed however. A large number of water molecules are therefore absorbed at the surface compared to electron emission films (25 degrees centigrade, 50% humidity under atmospheric pressure) that are not exposed to high humidity. Further, the drying time is approximately 10 minutes at a room temperature of 25 degrees centigrade at 50% humidity but the electron emission film 13 can hold moisture to an extent sufficiently suited to the object of the present invention if the time is within one hour.

After drying, the electron emission element is introduced to the vacuum chamber 211 of the processing apparatus 200 for the electron emission element and a vacuum is evacuated to $1\times10^{-4}$ Pa.

The anode 214 that is insulated from the emitter so as to face the emitter is then disposed within the vacuum chamber 211. When a hydrophilic material is used at the surface of the anode 214, water molecules desorbed from the electron emission film 13 in the aging processing can be temporarily absorbed at the anode 214. It is then possible to alleviate abrupt changes in water vapor pressure within the vacuum chamber 211. Further, it is possible to observe electron emission distribution on the electron emission film 13 occurring in the aging processing by capturing fluorescence emitted from the transparent anode 214 using the image-capturing apparatus 223.

During aging processing, a peak voltage applied to the field emission type electrode or mounting table and anode 214 and a duty ratio can be arbitrarily changed and a pulse voltage applied. The voltage applied to the electron emission element and anode 214 and the current flowing via the electron emission element are measured at the same time. Electron emissions are therefore intermittently generated and aging is carried out by applying a fixed field intensity (applied voltage/distance between electrodes) periodically for a fixed time.

Further, aging processing is carried out while successively evaluating the electron emission quantity and voltage changing in a pulsating manner using measuring means such as an oscilloscope. The aging processing then ends at a time where change in the electron emission density converges.

Figure 14A:
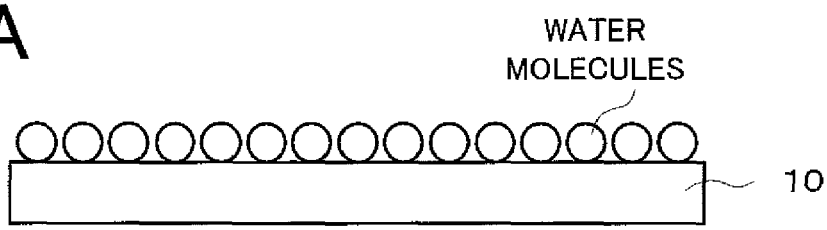
FIGS. 14A to 14D are diagrams schematically illustrating a process activating electron emission sites.
Figure 14B:
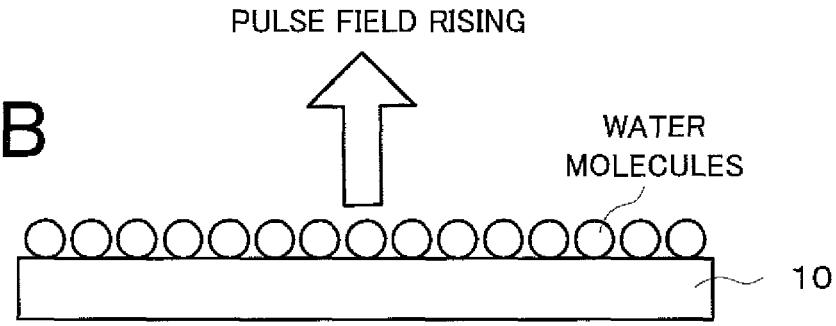
Figure 14C:
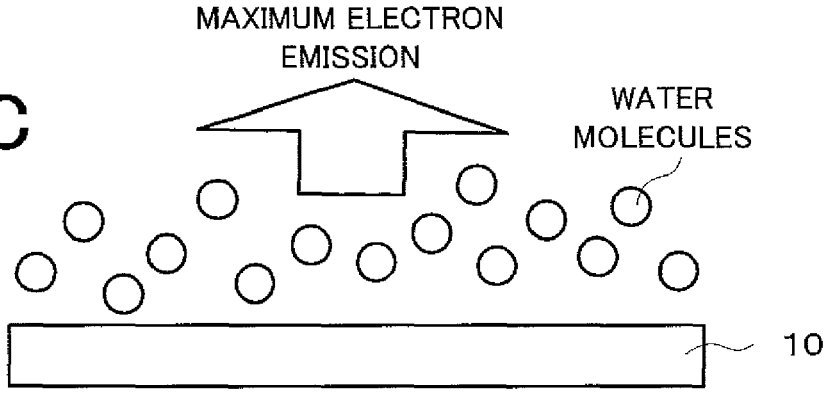
Figure 14D:
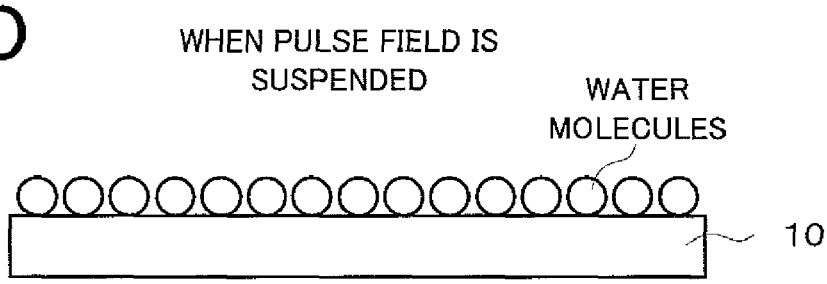

The following can be considered as a processing for activating the electron emission sites of an electron emission film that are inactive as a result of the aging processing occurring in the humidified state described above. First, in the state directly after film-forming, an inactive electron emission site exists where molecules or clusters impeding electron emissions are affixed to (or absorbed at) the surface of the field emission film of the field emission electrode. The water molecules shown in FIG. 14A are absorbed as a result of the humidification processing at the site. The absorption of the water molecules has the effect of lowering the apparent work function of the film surface, the threshold field intensity of the electron emission falls, and emission of electrons from the electron emission sites commences as shown in FIG. 14B. The absorbed water molecules are then desorbed as shown in FIG. 14C by the electron emissions but at the same time, the molecules and clusters that were the cause of inactivity are also removed. Regions that have been inactive up until this point then change to an active state. Further, some of the water molecules desorbed from the electron emission sites as shown in FIG. 14D are then reabsorbed to the electron emission film (or to the fluorescent substance formed on the electrode facing the electron emission film 13) during a pulse field rest time (or while the field intensity is less than the electron emission threshold intensity). Further, some of the water molecules are absorbed at as-yet inactive electron emission sites. Further, as the processes in FIGS. 14B to 14D are repeated, activated electron emission sites gradually increase as a result of repeatedly absorbing and desorbing the water molecules. It can therefore be considered that the electron emissions increase slowly for a rapid pulse frequency (order of kilohertz) and the electron emission density becomes uniform.

In the aging processing, the speed of increase in electron emissions becomes faster as the electrical power applied across the electrodes becomes larger. However, the partial pressure of the water vapor across the electrodes also becomes larger accordingly. The possibility of the electron emission film being damaged as a result of being bombarded with ions therefore also increases. It is therefore necessary to maintain the water vapor partial pressure across the electrodes at a pressure large enough to effect activation of the electron emission sites but low enough that there is substantially no degradation due to ion bombardment, by regulating peak electron emission density changing as a result of changing of the pulse frequency of the drive source, the duty ratio, or the peak voltage as described in detail in the following using the drawings to an appropriate amount. It is therefore possible to optimize the quantity of electron emission sites that are activated as a result of aging by selecting these conditions. It is also preferable to subject these parameters to feedback control from data measured in the aging process. It is also possible to evaluate the distribution conditions of the electron emissions from the emission state of the fluorescent substance in real time by adopting conditions for the applied voltage, electron emission density, and the duty ratio that do not cause the luminance of the fluorescent substance to saturate.

In the following, the amount of increase in electron emission density when the pulse duty ratio, the pulse frequency, and the initial field emission intensity occurring in the aging processing are changed is shown.

Figure 15:
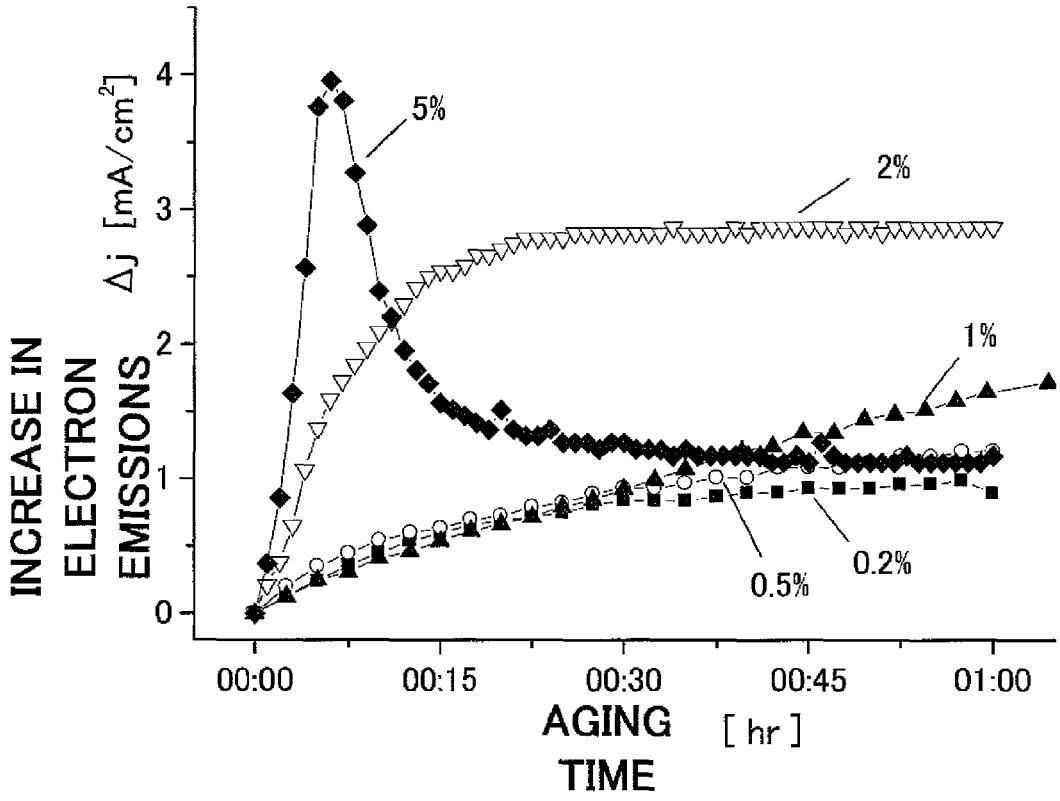
FIG. 15 is a diagram showing dependency with respect to pulse duty ratio for change in electron emission over time in aging processing.

First, dependency with regards to pulse duty ratio for change over time of the electron emissions in the aging processing is shown in FIG. 15. In FIG. 15, an increase ($\Delta j$) from the initial state of electron emission density is taken to be the vertical axis, and change over time is plotted because there is fluctuation in the initial electron emission density depending on the electrode used.

The electron emission distribution for before aging of the field emission electrode utilizes a 19 mm×39 mm millimeters field emission electrode of substantially the same extent of unevenness. Aging processing then takes place at the processing apparatus 200 shown in the drawings with exposure taking place for the order of one minute at a room temperature of 25 degrees centigrade at 100% humidity, with drying taking place thereafter at 50% humidity. At the processing apparatus 200, application of a pulse voltage starts when the initial degree of vacuum becomes $1\times10^{-4}$ Pa using ITO and a glass fluorescence board as the anode. Further, a cycle period for the pulse voltage is 500 Hz, peak field intensity due to the pulse voltage is 1.2V/μm, and electron emission density (electron emissions/field emission electrode surface area) during the initial peak is 2 mA/cm$^2$. The pulse duty ratio changes each field emission electrode 10 to 0.2%, 0.5%, 1%, 2%, and 5%, and electrical power consumed by the fluorescence board of ITO and glass is, in order from 0.2%, 0.02 W/cm$^2$, 0.05 W/cm$^2$, 0.1 W/cm$^2$, 0.2 W/cm$^2$, and 0.5 W/cm$^2$.

As is clear from FIG. 15, the increase $\Delta j$ is smooth at a duty ratio of 0.2% and 0.5%, and tends towards saturation at 1 mA/cm$^2$. At 1%, there is an increase of 1.5 mA/cm$^2$ or more at approximately one hour, and a tendency to further increase is maintained. Further, after 20 minutes elapses at 2%, a saturated state is reached where electron emissions do not increase. At 5%, a peak is reached five minutes after starting. After this, a tendency for electron emissions to decrease is exhibited. This is because the partial pressure of water to the electrodes is too large, the electron emission film surface is degraded by ion bombardment, and the electron emission site is degraded.

Figure 16:
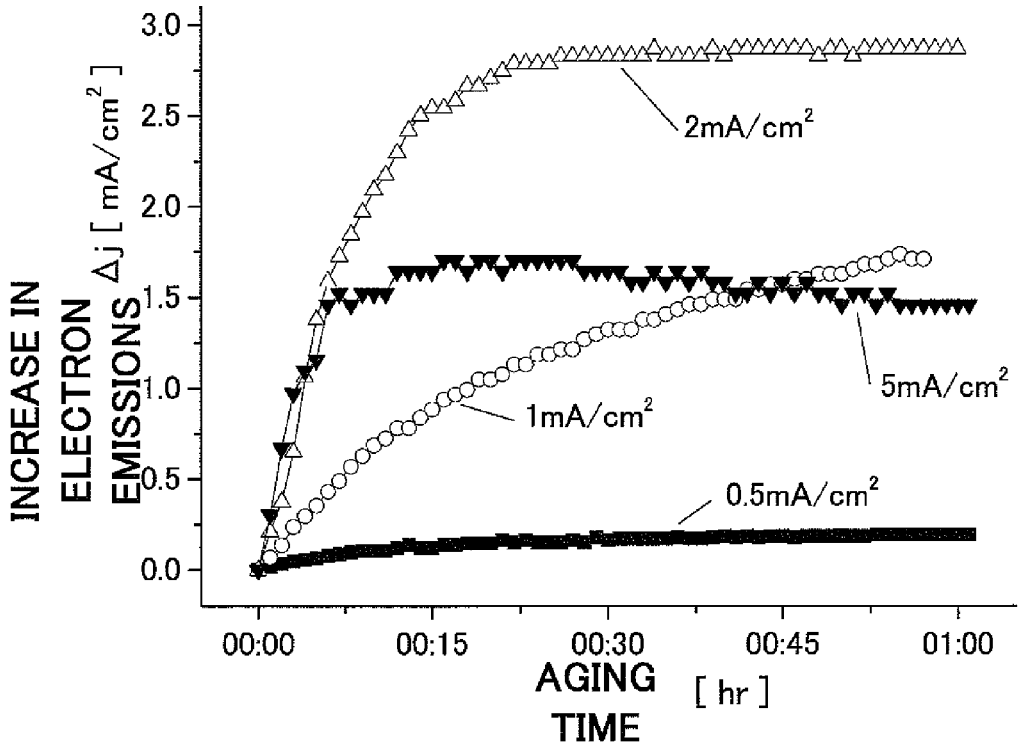
FIG. 16 is a diagram showing dependency with respect to initial electron emission density for change in electron emission over time in aging processing.

Next, dependency with respect to initial electron emission density for the change in electron emissions over time occurring in aging processing where peak voltages during pulses are different is shown in FIG. 16. In FIG. 16, the increase ($\Delta j$) from an initial state of the electron emission density is taken to be the vertical axis, and the horizontal axis is taken to be aging time.

The electron emission distribution for before aging of the field emission electrode utilizes a 19 mm×39 mm field emission electrode of substantially the same extent of unevenness. Aging processing then takes place at the processing apparatus 200 shown in the drawings with exposure taking place for the order of one minute at a room temperature of 25 degrees centigrade at 100% humidity, and drying then taking place for approximately 10 minutes at 50% humidity. At the processing apparatus 200, an ITO and a glass fluorescence board are used as the anode. The pulse voltage is 500 Hertz and the pulse duty ratio is 2%. Measurement starts from when the degree of vacuum within the chamber is $1\times10^{-4}$ Pa. Further, electron emission intensities for the peak voltages during pulses for each field emission electrode 10 for respective initial states of 0.5 mA/cm$^2$, 1 mA/cm$^2$, 2 mA/cm$^2$, and 5 mA/cm$^2$ are used for the field emission electrode.

As is clear from FIG. 16, it can be seen that there is a tendency for the speed of increase in electron emissions to increase as the initial peak electron emission density becomes higher at 0.5 mA/cm$^2$, 1 mA/cm$^2$, and 2 mA/cm$^2$. The electron emission characteristics can be seen to improve the most for 2 mA/cm$^2$ when the aging processing takes place for 15 minutes or more. Further, the saturation value can also be seen to tend to be higher for a higher initial peak electron emission density. However, for 5 mA/cm$^2$, after aging starts, and the increasing reaches a peak at around 10 minutes, it can be seen that the electron emissions have a tendency to gradually reduce. This shows that the water vapor partial pressure between the electrodes rises due to the absolute quantity of electron emissions and the power consumed by the anode 214 becoming large, and that the deterioration of the film starts up as a result of the extent that the electron emission film 13 is subject to ion bombardment becoming large.

Figure 17:
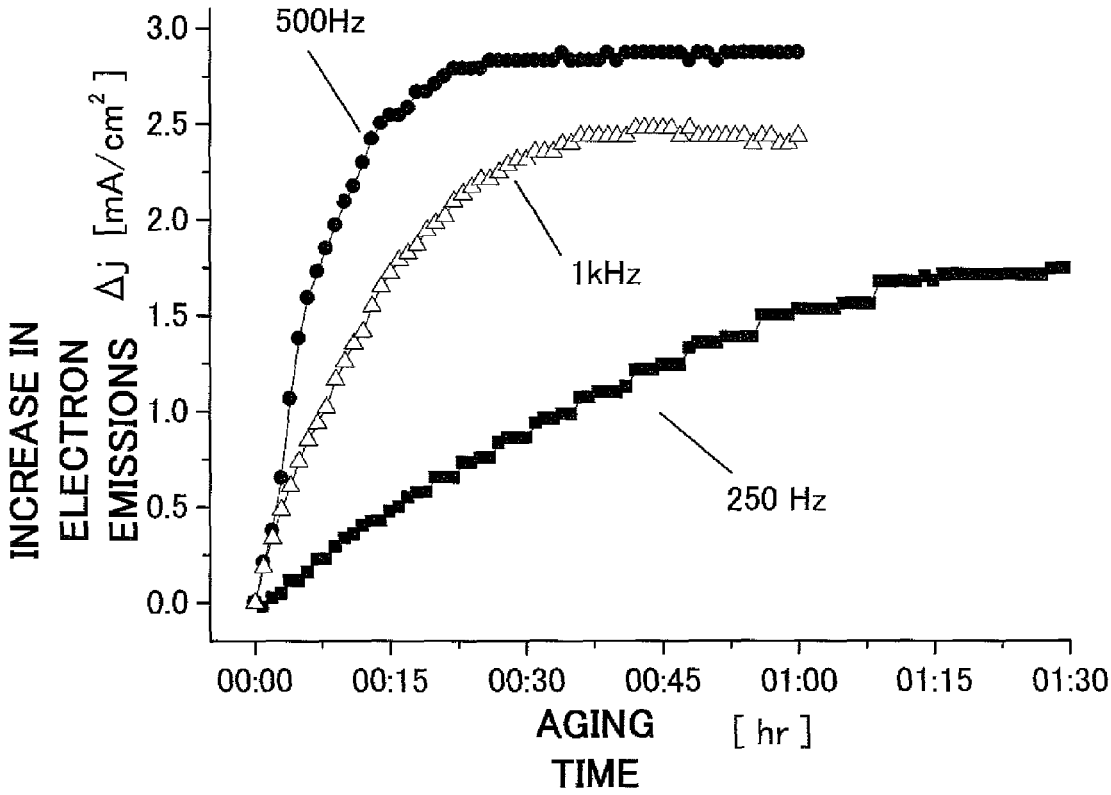
FIG. 17 is a diagram showing dependency with respect to pulse frequency for change in electron emission over time in aging processing.

Next, dependency with respect to pulse frequency as the electron emissions change over time at the time of a pulse peak in aging processing where a peak cycle period is different during a pulse is shown in FIG. 17. In FIG. 17, the increase ($\Delta j$) from an initial state of the electron emission density is taken to be the vertical axis, and the horizontal axis is taken to be aging time.

The electron emission distribution for before aging of the field emission electrode utilizes a 19 mm×39 mm field emission electrode of substantially the same extent of unevenness. Aging processing then takes place at the processing apparatus 200 shown in FIG. 13 with exposure taking place for the order of 1 minute at a room temperature of 25 degrees centigrade at 100% humidity, and drying then taking place for approximately ten minutes at 50% humidity. At the processing apparatus 200, an ITO and a glass fluorescence board is used as the anode 214. Further, the pulse duty ratio is taken to be 2%, and the initial peak electron emission density is taken to be 2 $mA/cm^2$. Measurement starts from when the degree of vacuum within the chamber is $1\times10^{-4}$ Pa. Aging is carried out at differing pulse frequencies of 250 Hz, 500 Hz, and 1 kHz every field emission electrode 10.

As is clear from FIG. 17, the speed of increase in electron emissions and the saturation value for the amount of increase are both at a maximum when carrying out aging at 500 Hz.

The reason the increase in speed is slow at 250 Hz can be considered to be because as the pulse frequency becomes slow, the absorption/desorption cycles for the water molecules per unit time become fewer and the speed that inactive electron emission sites become active at becomes slower.

On the other hand, the increase in speed and saturation values being lower at 1 kHz compared to 500 Hz can be considered to be because the desorption speed for the water molecules per unit time becomes slower. The water vapor pressure therefore rises and the electron emission film is strongly bombarded with ions. This is because it can also be demonstrated that the increase in electron emissions (i.e. the absolute value for electron emission density) gradually falls from the aging time exceeding 40 minutes.

In this way, from FIG. 15 to FIG. 17, the pulse duty ratio, the pulse peak voltage, and the pulse frequency are adjusted appropriately according to the initial electron emission density and it can be said that it is necessary to set conditions for the aging processing.

Next, baking processing is carried out. Baking processing is carried out with, for example, the field emission electrode being heated to, for example, 550 degrees centigrade to 1000 degrees centigrade within the vacuum chamber. The quantity of electron emissions from the electron emission film increases in accordance with the passage of time of the aging processing but is limited by the quantity of inactive electron emission sites. The increase in electron emissions therefore converges on a certain level. Because of this, the electron emission state is measured in real time and the aging ends a the stage where the amount of change reaches a stipulated numeric value. As described above, the aging processing is carried out while maintaining vacuum evacuation. The quantity of water molecules existing in the space between the electron emission film of the field emission electrode and the anode at the time of ending the aging processing is reducing more than in the initial stage of the aging processing. However, the possibility that water molecules absorbed at portions that are not electron emission sites (electron emission film surface) of the field emission electrode will remain absorbed after aging processing is high. As a result, it is necessary to carry out desorption of water molecules absorbed at portions other than electron emission sites by heating in a vacuum after aging is completed.

Figure 18A:
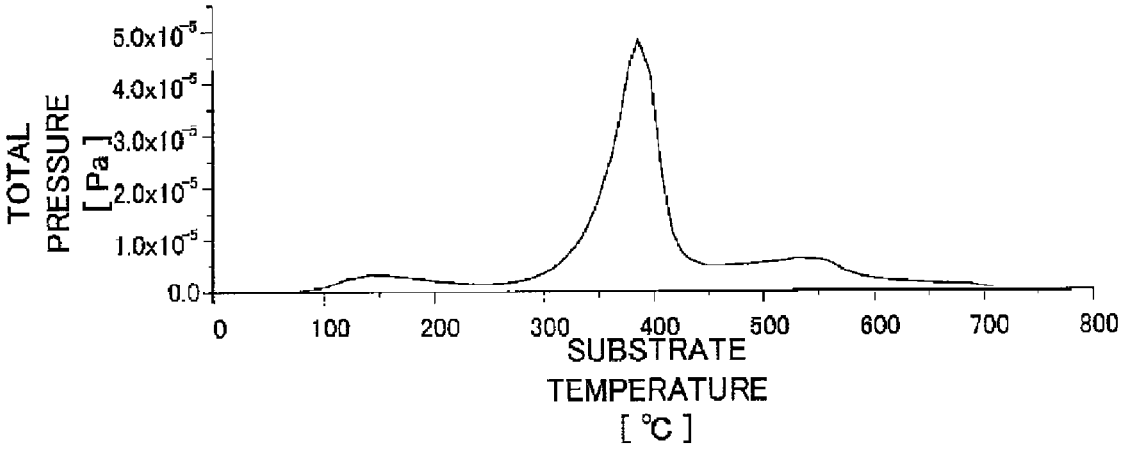
FIGS. 18A and 18B are diagrams showing mass spectrometry results for baking processing.
Figure 18B:
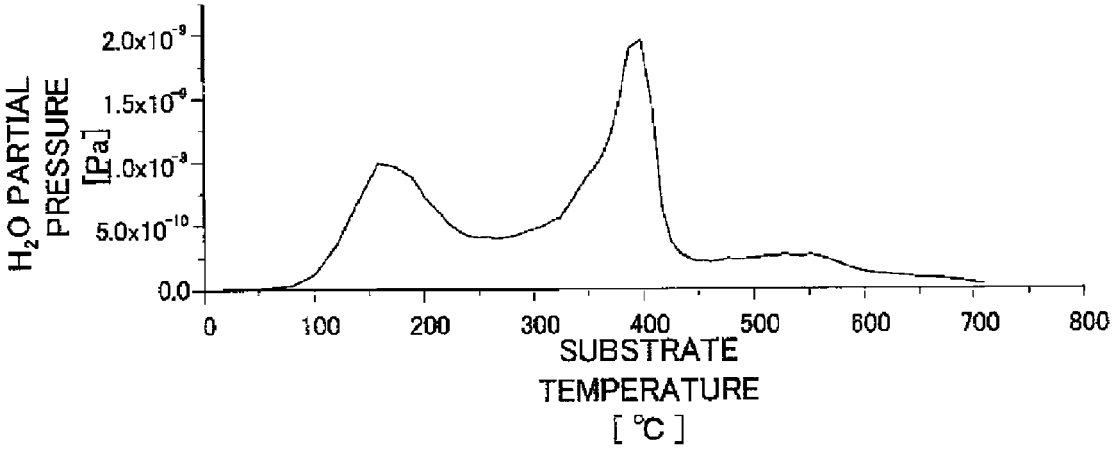

Next, the field emission electrode 10 is mounted within a vacuum heating apparatus and a vacuum atmosphere of less than $5\times10^{-4}$ Pa is created. Aging is then implemented until a temperature of 800 degrees centigrade is reached at the humidified electron emission film with the temperature rising at 1 degree centigrade/second. The results of temperature programmed desorption mass spectrometry are shown in FIG. 18A and FIG. 18B. As is clear from FIGS. 18A and 18B, the CNW 31 and the microcrystal diamond film 32 of the field emission electrode 10 have a final peak for partial pressure of $H_2O$ for full pressure at 550 degrees centigrade. From 550 degrees centigrade upwards, the partial pressure has a tendency to reduce with respect to the rise in temperature and from 700 degrees centigrade onwards, the values for both fall below measurement limits. As a result, it can be understood that the maximum for the activation energy for the absorbed molecules is $\epsilon=k\cdot(273+550)=1.1433\ 10^{-20}$ J (in a range of 800 degrees centigrade or less). It can therefore be said that, based on the above analysis, the moisture is desorbed from the electron emission element effectively at a heating temperature of 550 degrees centigrade or more in the vacuum heating processing for after the aging processing.

Figure 19:
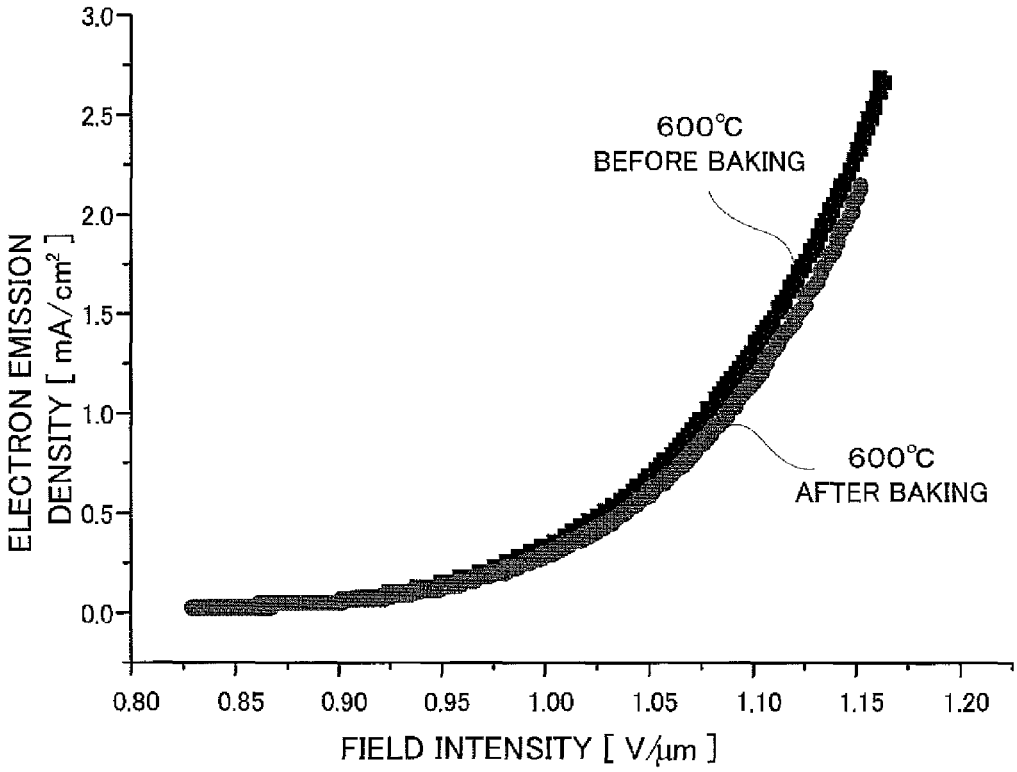
FIG. 19 is a graph showing change in electron emission characteristics occurring at a heating temperature 600 degrees centigrade.
Figure 20:
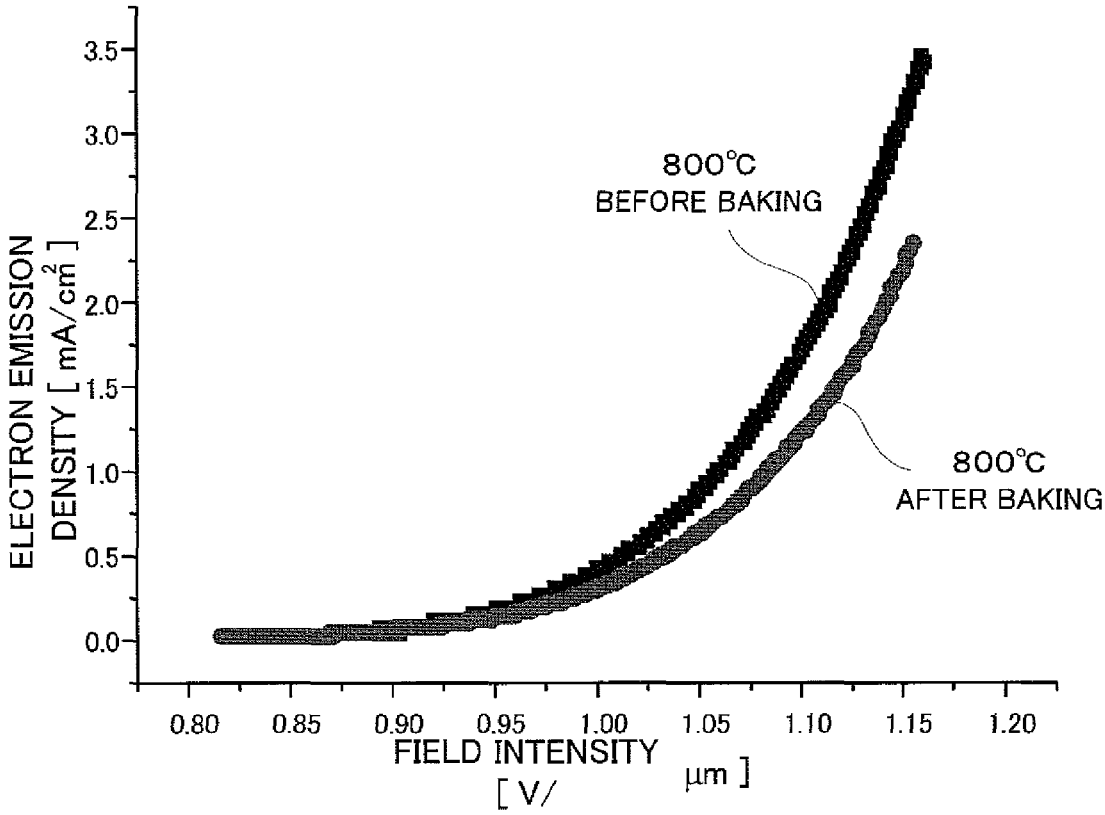
FIG. 20 is a graph showing change in electron emission characteristics occurring at a heating temperature of 800 degrees centigrade.
Figure 21:
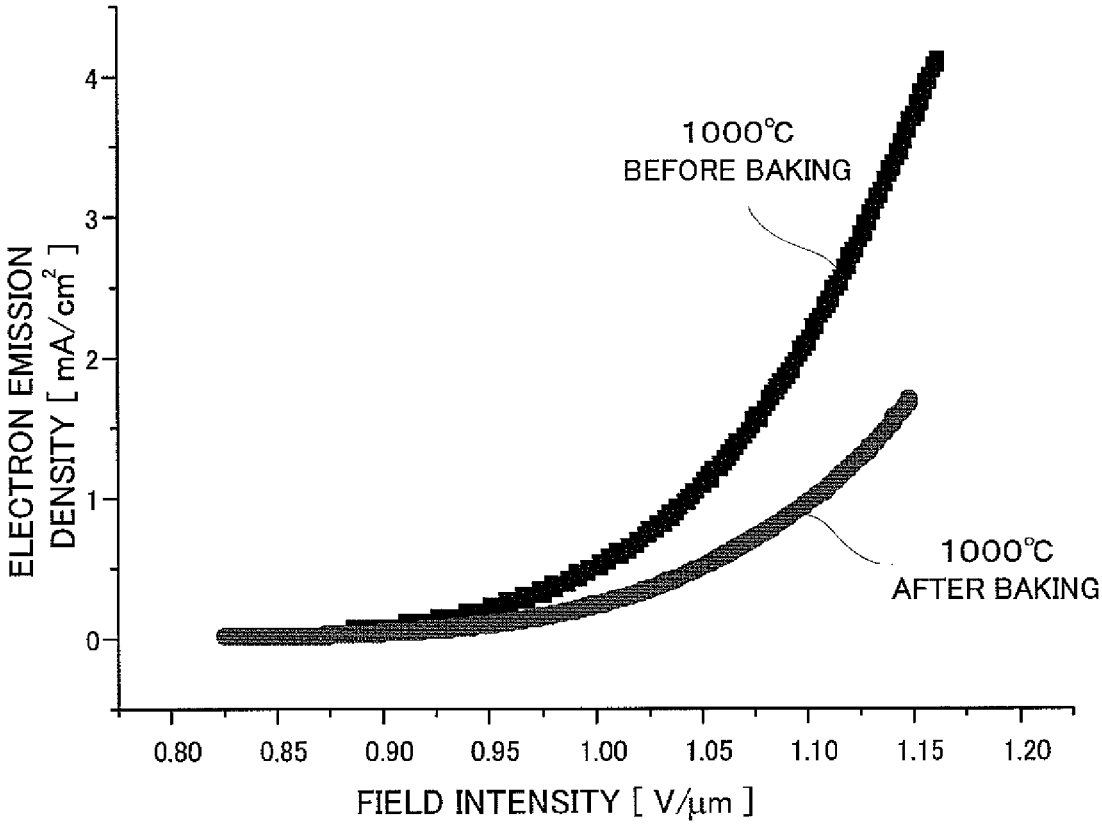
FIG. 21 is a graph showing change in electron emission characteristics occurring at a heating temperature of 1000 degrees centigrade.

The electron emission element subjected to humidification aging to increase electron emissions and make electron emissions uniform is then subjected to vacuum heating at a pressure of $5\times10^{-4}$ Pa or less, at temperatures of 600 degrees centigrade, 800 degrees centigrade, and 1000 degrees centigrade, for one hour and changes in each of the electron emission characteristics are compared. The results are shown in FIGS. 19 to 21. FIG. 19 is a graph showing change in electron emission characteristics occurring at a heating temperature of 600 degrees centigrade, FIG. 20 is a graph showing change in electron emission characteristics occurring at a heating temperature of 800 degrees centigrade, and FIG. 21 is a graph showing change in electron emission characteristics occurring at a heating temperature of 1000 degrees centigrade.

Figure 22A:
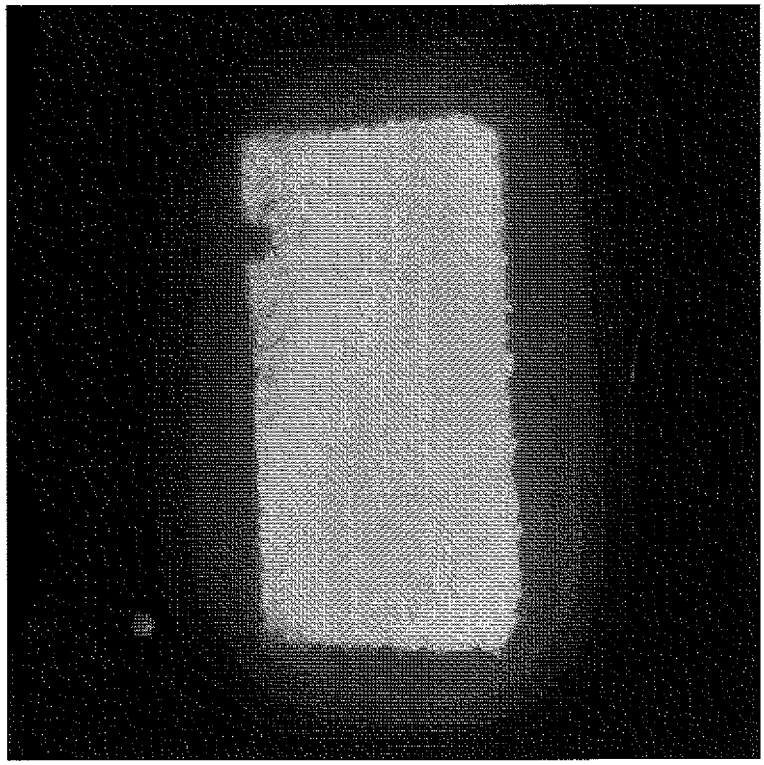
FIG. 22A is an image showing fluorescence board luminescence before baking processing.
Figure 22B:
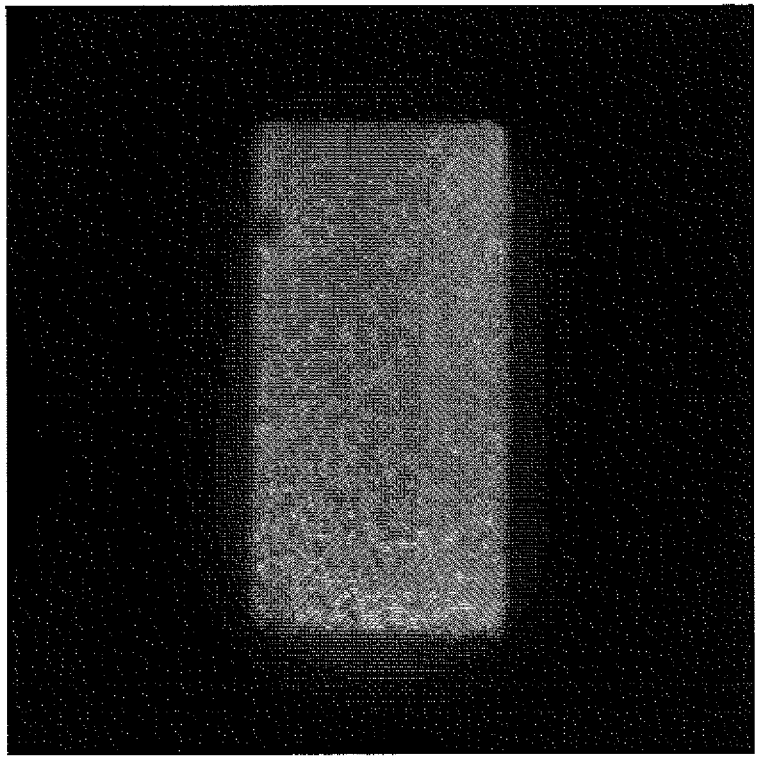
FIG. 22B is an image showing fluorescence board luminescence after baking.
Figure 23:
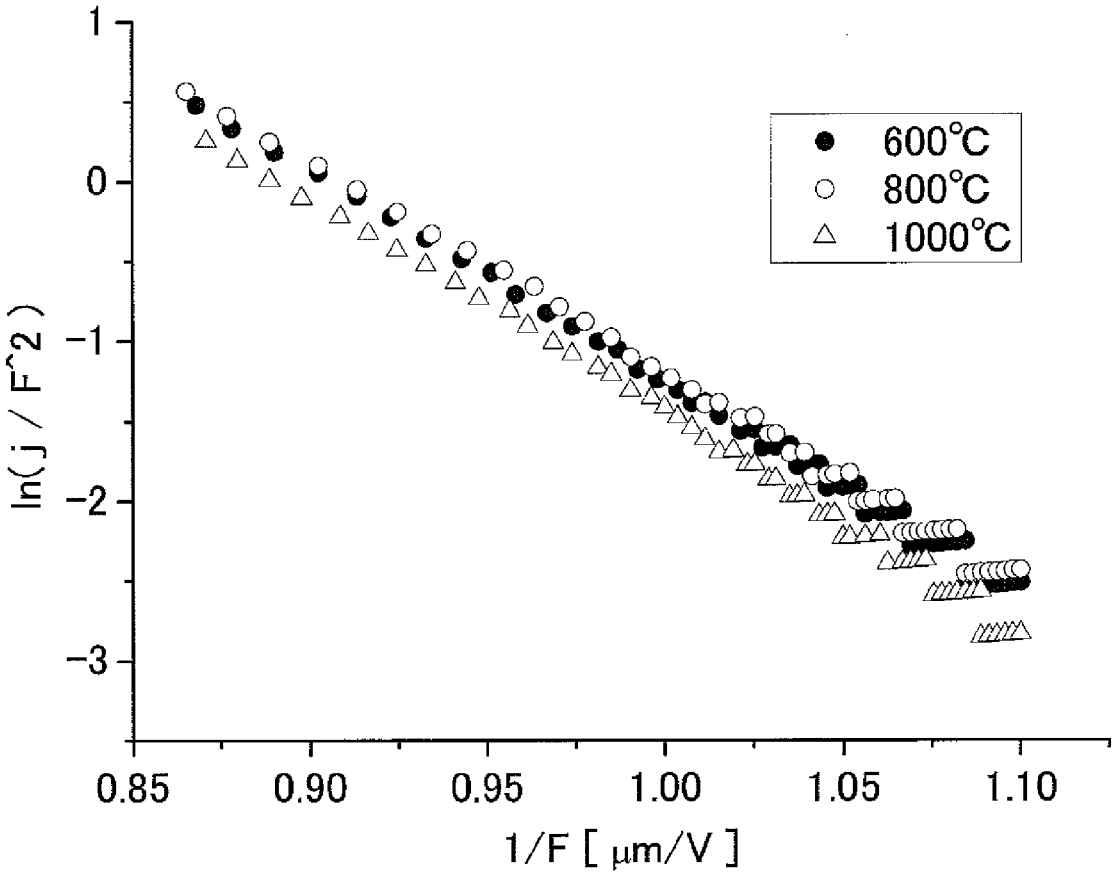
FIG. 23 is a graph of an FN plot of I-V characteristics of electron emission elements processed at each of the temperatures of 600, 800, and 1000 degrees centigrade.

It can be understood from FIGS. 19 to 21 that the electron emissions fall more before and after processing for a higher vacuum heating processing temperature. In the processing for 1000 degrees centigrade where the extent of degradation is largest, the fluorescence of the fluorescent substance 214*b* of the anode 214 used in the field emission electrode 10 before and after baking processing is shown in FIGS. 22A and 22B. FIG. 22A is fluorescence of the fluorescent substance 214*b* of the anode 214 used in the field emission electrode 10 before baking processing, and FIG. 22B is an image showing fluorescence of the fluorescent substance 214*b* of the anode 214 after baking processing. As is clear from FIGS. 22A and 22B, localized portions where the electron emission density deteriorates can be seen. Further, an F-N plot of the I-V characteristics of electron emission elements processed at each of the temperatures of 600, 800, and 1000 degrees centigrade is shown in FIG. 23. As is clear from FIG. 23, differences in inclination can be seen depending on the temperature. As a result, degradation of the electron emission characteristics due to increase in the processing temperature can be considered to be because the number of electron emission sites reduces due to being subjected to overall thermal etching rather than changes in the work function of the electron emission sites or field focusing factors at the electron emission sites. Electron emission elements subjected to processing at 1000 degrees centigrade are also in a range that can be sufficiently devoted to actual use but carrying out the vacuum heating processing at from 550 degrees centigrade to 800 degrees centigrade is preferable in order to keep thermal etching to a minimum.

In the method of manufacturing a field emission electrode of this embodiment, humidification processing is implemented, and pulse voltages are applied to the field emission electrode with water molecules absorbed at the field emission film surface. As a result, it is possible to manufacture a field emission electrode where inactive electron emission sites of the electron emission film are made active to give comparatively uniform field emission intensity.

Further, in this embodiment, and in particular in the aging processing, abrupt changes in water vapor pressure are suppressed by making the electrode (anode) facing the field emission electrode hydrophilic. It is then possible to suppress damage to the surface of the field emission film.

First Embodiment

Next, in order to look at results for carrying out aging using a humidified state, aging is carried out by implementing humidification processing and the case of implementing baking processing and the case of implementing aging processing and baking processing under the same conditions while omitting the humidification processing are compared.

First, the electron emission film 13 is formed on the substrate by the CVD apparatus under the conditions described above and the field emission electrode is made. Next, the electron emission film 13 of the field emission electrode formed in this manner is subjected to humidification processing. Specifically, the humidification processing is performed under a high humidity environment by exposure for around one minute at a room temperature of, for example, 25 degrees centigrade at 100% humidity. Drying then takes place for approximately ten minutes at 50% humidity.

Next, the humidified electron emission film 30 mm×30 mm in size is subjected to aging using the processing apparatus 200 under conditions of an applied voltage pulse wave height of 6 kV (1.4V/μm), a pulse frequency of 500 Hz, and a duty ratio of 0.5%. A fluorescent substance (ZnO:Zn) taken as a cathode and a fluorescence board provided with ITO and glass are used at the processing apparatus 200.

Figure 24A:
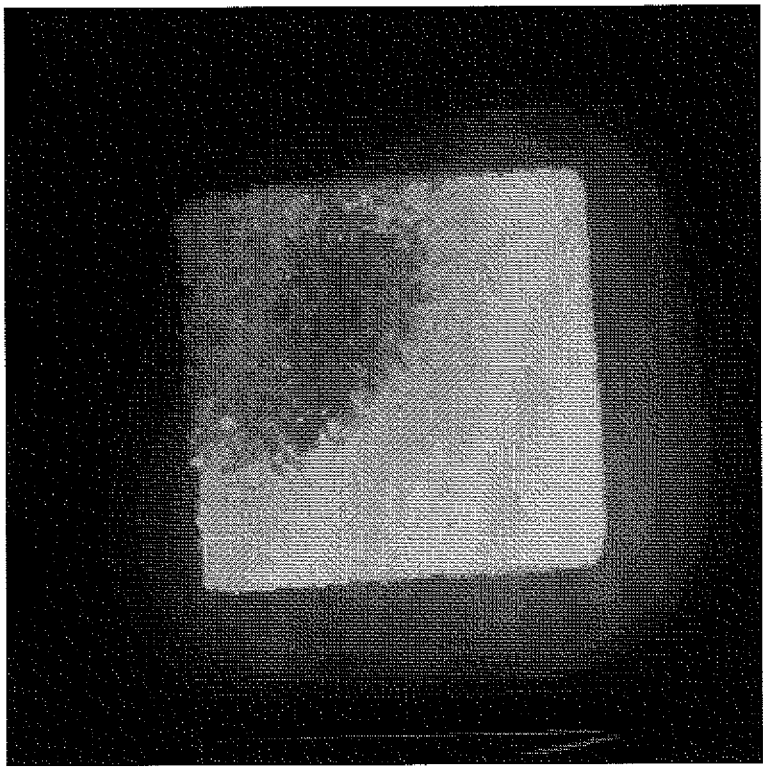
FIG. 24A is an image showing the appearance of fluorescence board luminescence due to electron emissions of a field emission electrode before aging.
Figure 24B:
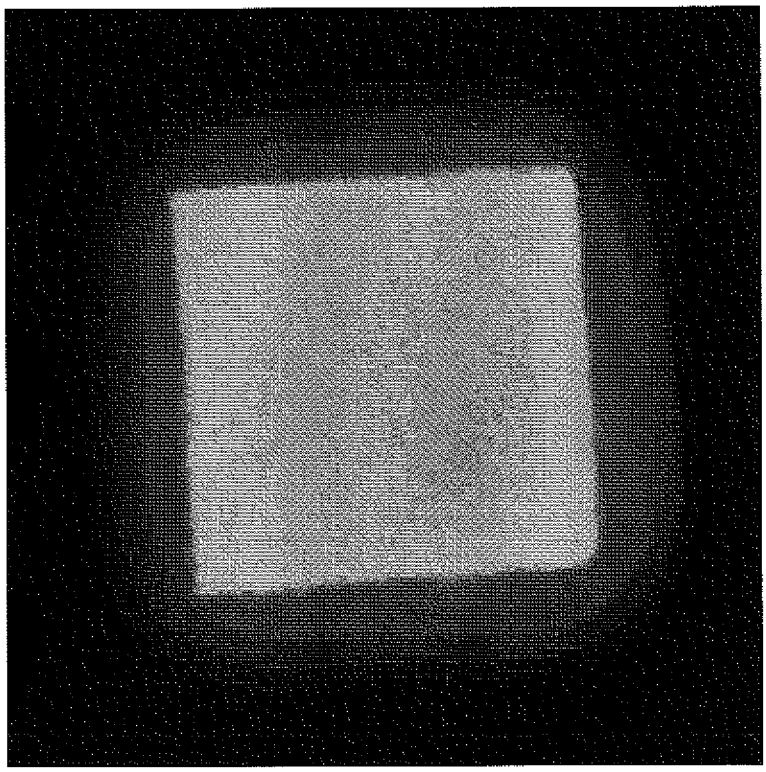
FIG. 24B is an image of fluorescence board luminescence due to electron emissions of the field emission electrode after being subjected to aging processing for one hour.
Figure 25:
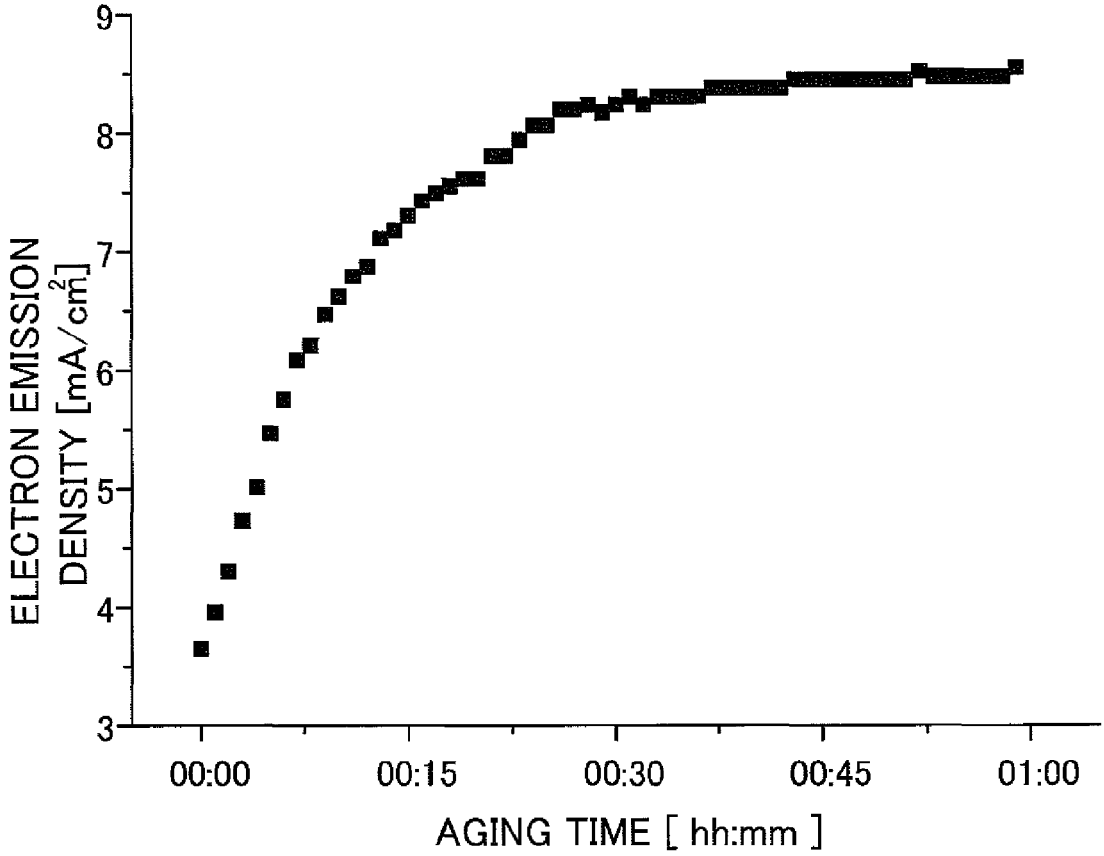
FIG. 25 is a graph showing the appearance of change in electron emission density over time in aging processing.

The appearance of fluorescence board luminescence due to electron emissions of the field emission electrode before aging (directly after film-forming) is shown in FIG. 24A. Electron emissions at other regions are suppressed because of extreme electron emissions at the right lower corner of the field emission electrode. FIG. 24B is an image showing fluorescence board luminescence due to electron emissions of the field emission electrode after being subjected to aging processing for one hour at the humidified electron emission film. Further, FIG. 25 is a graph showing change over time of the maximum electron emission density (electron emissions/electrode surface area) at the time of aging to the humidified electron emission film.

The extent of emissions at the region on the upper left of FIG. 24A is weak compared with other regions and it is clear that the field emission electrode has a bias in the electron emission characteristics directly after film-forming. With regards to this, emission is uniform over the whole of the field emission electrode subjected to aging processing shown in FIG. 24B, and compared to FIG. 24A, it can be understood that the radiation intensity is strong on the upper left. As shown in FIG. 25, this is because it can be demonstrated that the electron emission density increases as the aging time becomes longer.

Next, the field emission electrode subjected to humidification aging processing in this way is baked using vacuum heating. Specifically, the pressure when starting baking is taken to be $5\times10^{-4}$ Pa or less, the temperature is taken to be 800 degrees centigrade, and the baking time is taken to be one hour.

Figure 26A:
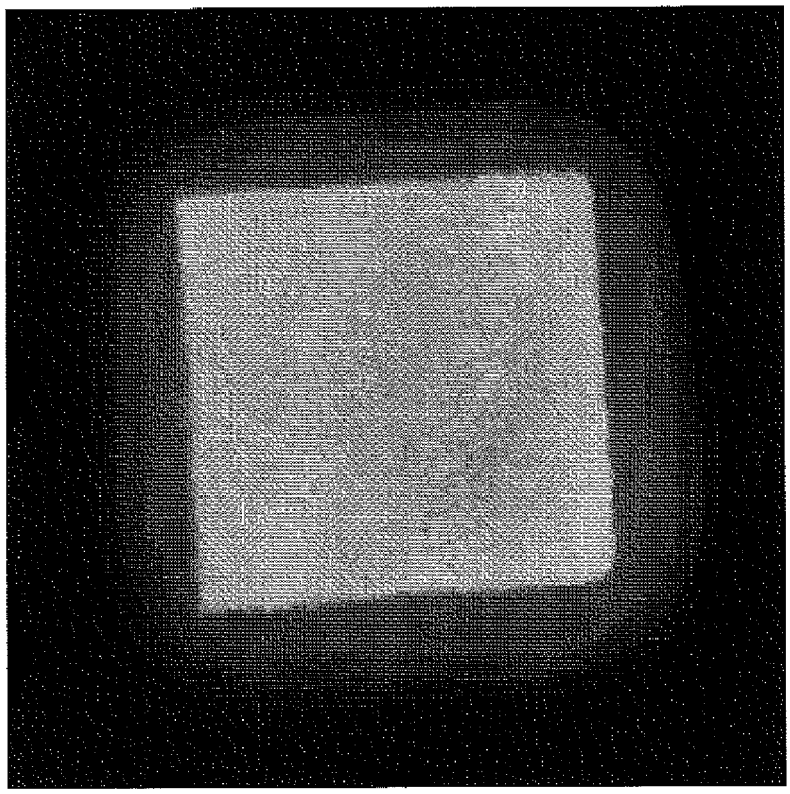
FIG. 26A is an image showing the appearance of fluorescence board luminescence due to electron emissions of the field emission electrode before baking.
Figure 26B:
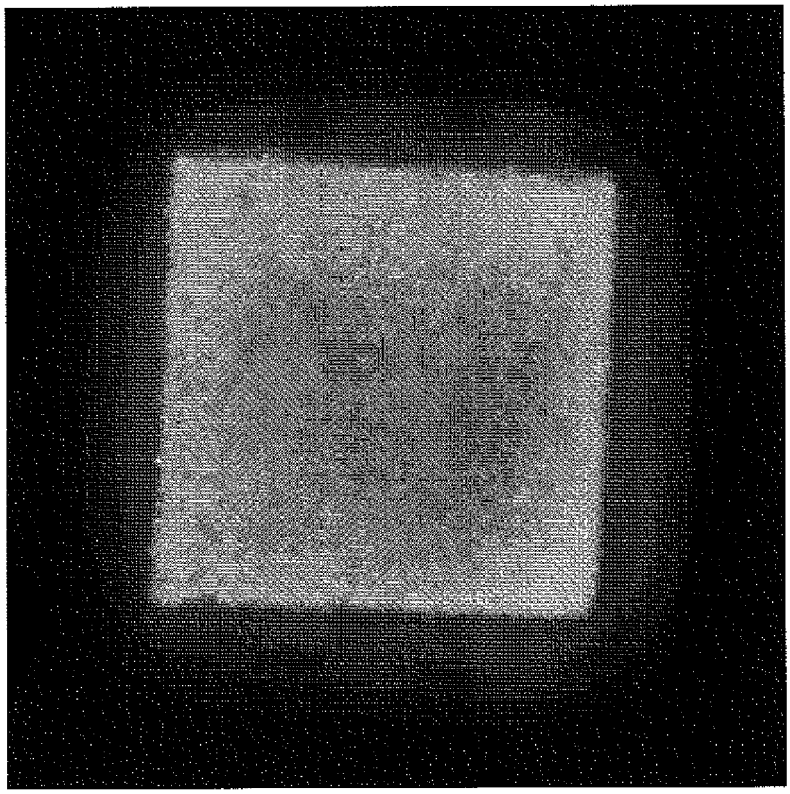
FIG. 26B is an image showing fluorescence board luminescence due to electron emissions of the field emission electrode after being subjected to baking processing for one hour.
Figure 27:
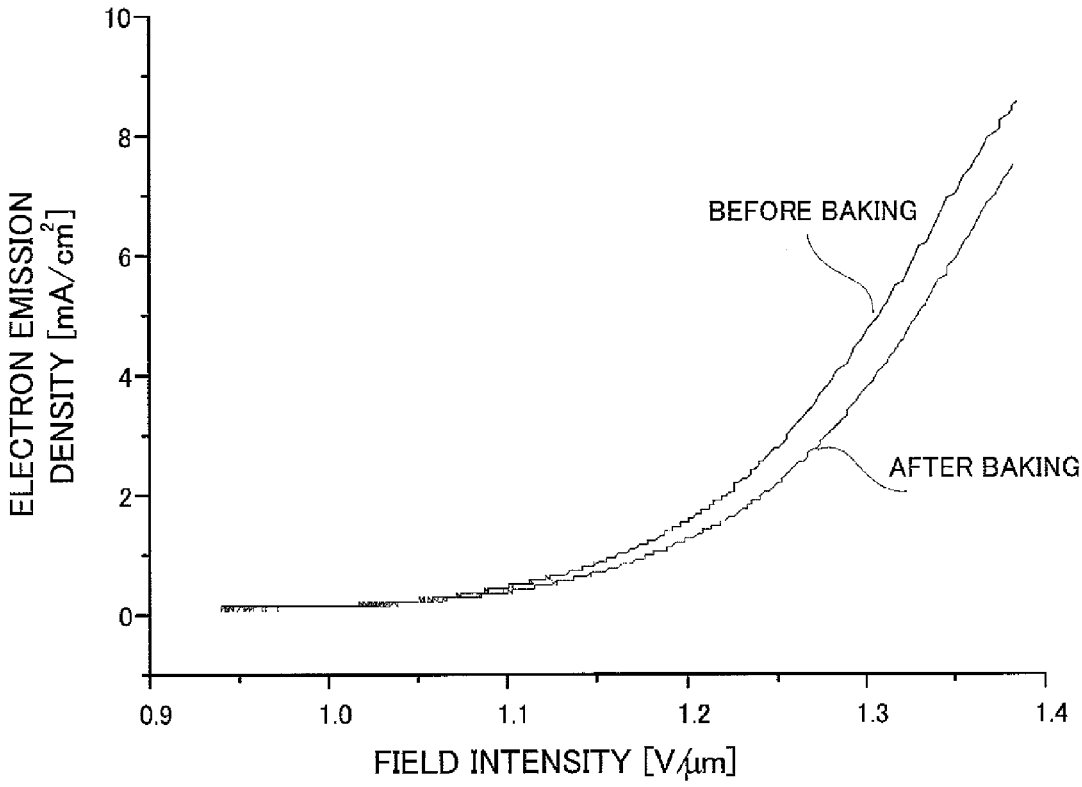
FIG. 27 is a graph showing I-V characteristics before and after baking.
Figure 28:
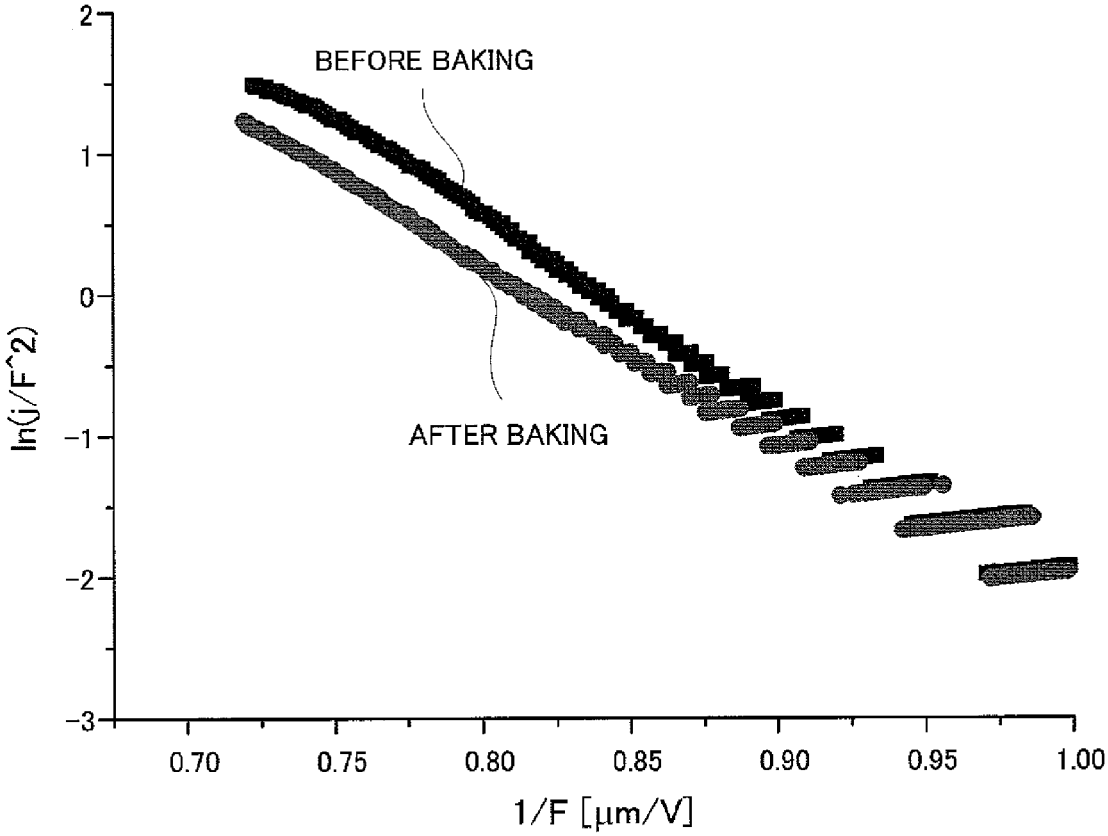
FIG. 28 is an FN plot for before and after baking.

The appearance of the fluorescence board luminescence due to electron emissions of the field emission electrode before baking and after being subjected to the humidification aging processing of FIG. 24B is shown in FIG. 26A. FIG. 26B is an image showing the fluorescence board luminescence due to electron emissions of the field emission electrode after being subjected to baking processing for one hour after being subjected to the humidification aging processing of FIG. 24B. Further, FIG. 27 is a graph showing I-V characteristics for before and after baking of the field emission electrode subjected to the humidification aging processing, and FIG. 28 is an FN plot for before and after baking of the field emission electrode subjected to humidification aging processing.

As is clear from FIGS. 26A and 26B, it can be seen that the electron emission characteristics of the field emission electrode deteriorates slightly before and after baking and that the uniformity is not ruined. Further, from FIG. 28 it can be seen that gradient of the FN plot for before baking is curved whereas the gradient of the FN plot after baking is substantially a straight line. This shows that the influence of absorbed water molecules remaining at the electron emission sites when humidification aging is complete is eliminated by baking. Further, it can also be understood from FIG. 27 that the threshold voltage (field intensity brought of 1 mA/cm$^2$) for after baking is 1.05V/μm.

Next, an explanation is given using the drawings of the field emission electrode when aging processing and vacuum heating processing are implemented without implementing humidification processing.

Figure 29A:
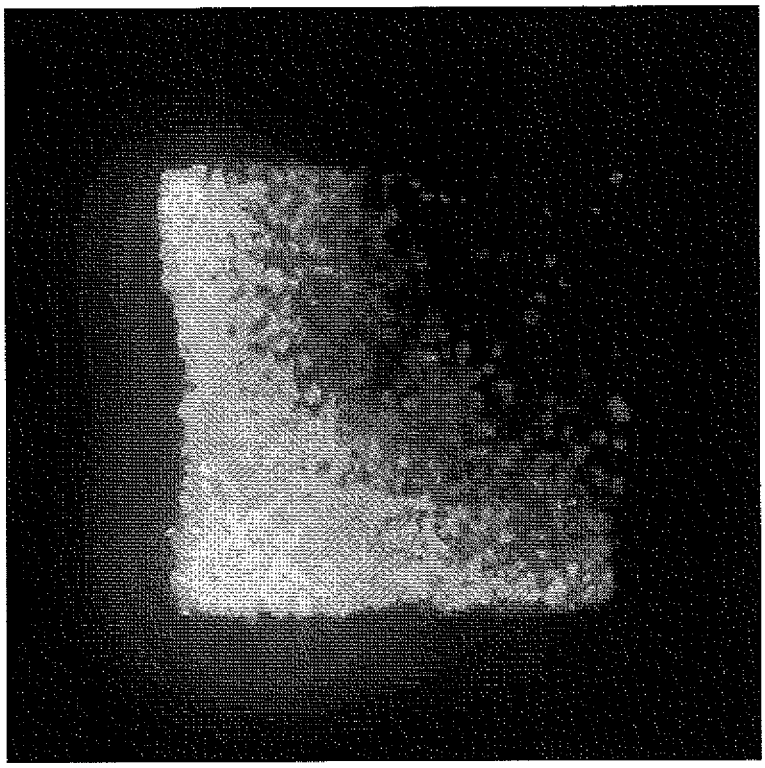
FIG. 29A is an image showing the appearance of fluorescence board luminescence due to electron emissions of a field emission electrode before aging.
Figure 29B:
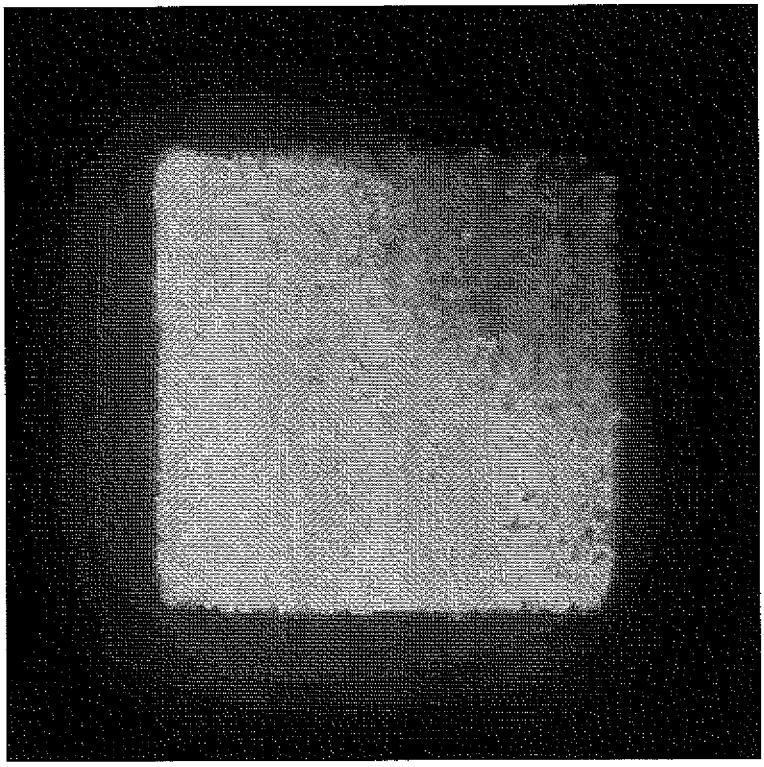
FIG. 29B is an image showing fluorescence board luminescence due to electron emissions of the field emission electrode after being subjected to aging processing for one hour.
Figure 30:
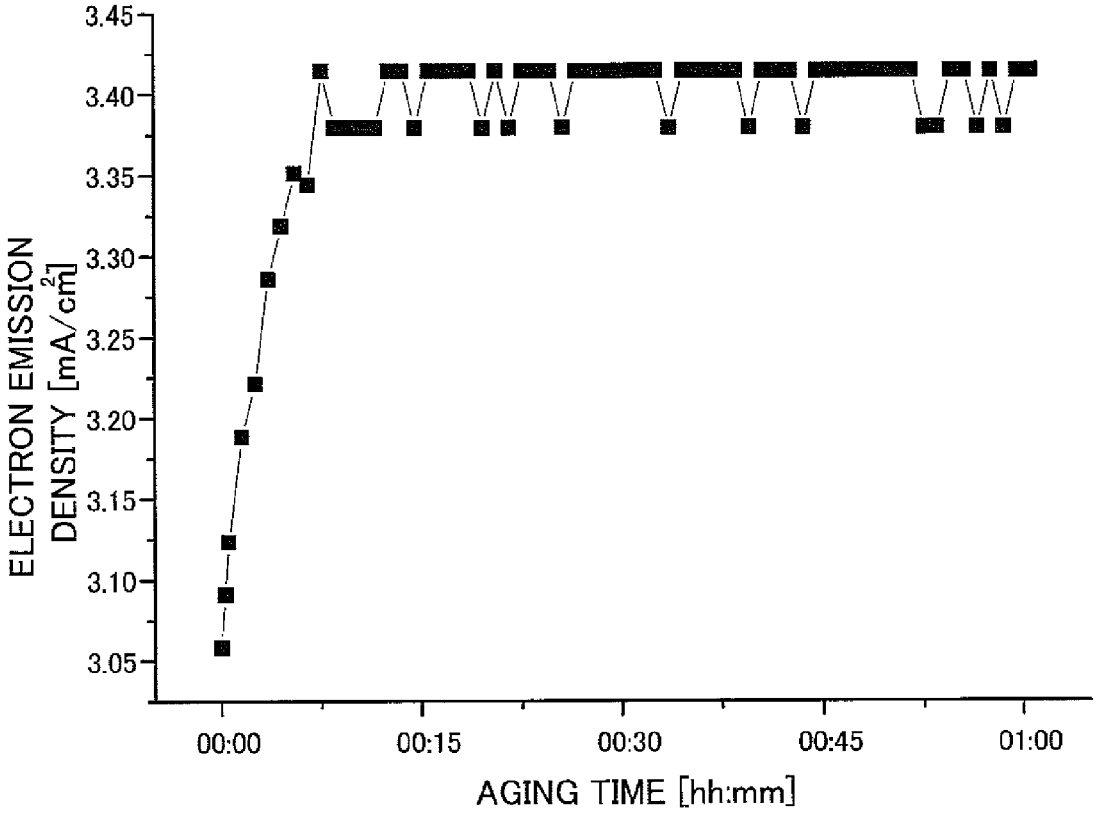
FIG. 30 is a graph showing change in electron emission density over time when a gate is on (1.4V/μm)
Figure 31:
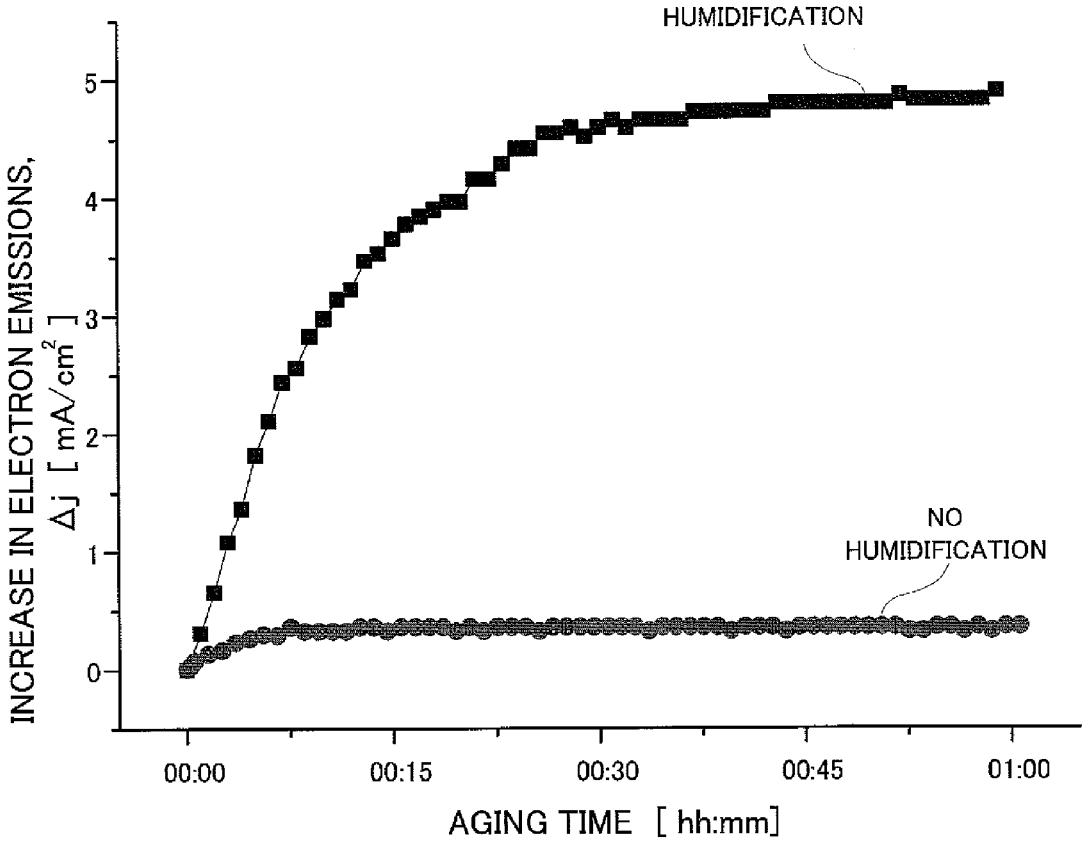
FIG. 31 is a graph showing differences in the change in electron emission characteristics over time depending on the presence or absence of humidification processing.

First, the characteristics of the field emission electrode when aging processing takes place but humidification processing is not implemented is shown in FIGS. 29 to 31. FIG. 29A shows the appearance of fluorescence board luminescence due to electron emissions of the field emission electrode before aging. FIG. 29B is an image showing fluorescence board luminescence due to electron emissions of the field emission electrode after being subjected to aging processing for one hour without carrying out humidification processing. FIG. 30 is a graph showing the change over time of the maximum electron emission density at the time of aging at 1.4V/μm. FIG. 31 is a graph showing differences in the change in increase in electron emissions over time of a field emission electrode subjected to aging processing depending on the presence or absence of humidification processing.

In FIG. 29A, the extent of emissions for the fluorescence board at the upper right of the field emission electrode is weak compared to other regions and it can be understood that there is a bias present in the electron emission density. Next, in FIG. 29B, the emission region has broadened compared to FIG. 29A. Improvement in the electron emission density can therefore be seen even in cases where humidification processing is not implemented. However a region remains on an upper right region where emission does not take place. It can therefore be understood that localized bias of electron emission remains compared with the case where humidification processing is implemented. It can be understood from FIG. 30 that the electron emission density saturates around 10 minutes after the start of the aging processing when humidification processing does not take place. On the other hand, it can be understood that electron emission takes place slowly up until one hour and reaches a saturation state slowly when the humidification processing is implemented as shown in FIG. 25. It is also emphatically clear from FIG. 31 that the increase in electron emissions is greater for aging where humidification processing is implemented.

The speed of increase of the electron emissions and the saturation value therefore differ substantially in aging where humidification processing is not carried out. It can therefore be said that humidification processing is necessary for activating electron emission sites effectively.

Next, an explanation is given using the drawings of a field emission electrode that is not subjected to the humidification processing described above but is subjected to aging processing and baking processing. Specifically, the pressure when starting baking is taken to be $1\times10^{-4}$ Pa or less, the temperature is taken to be 800 degrees centigrade, and the baking time is taken to be one hour.

Figure 32A:
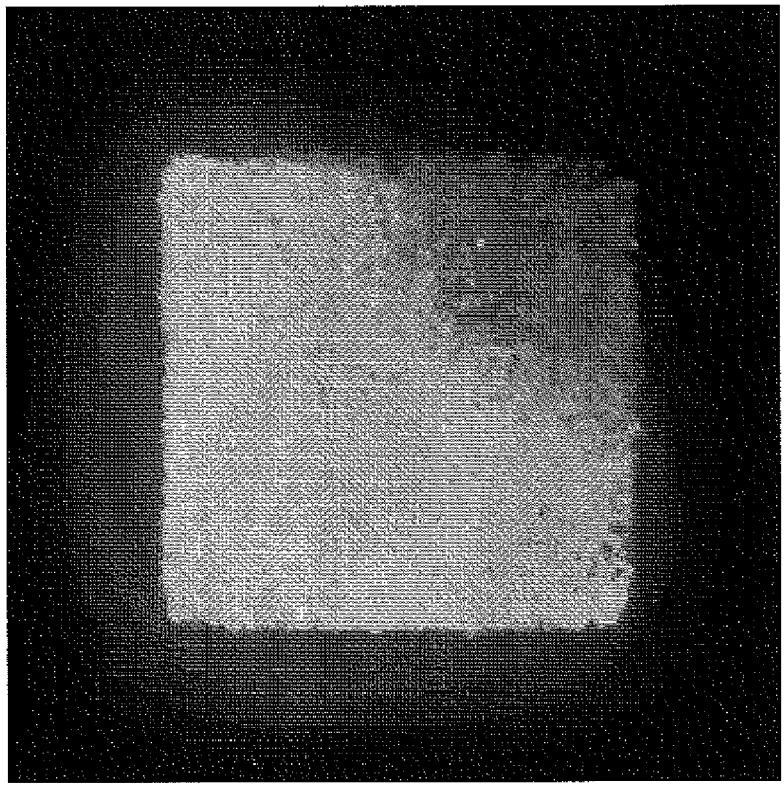
FIG. 32A is an image showing the appearance of fluorescence board luminescence due to electron emissions of the field emission electrode before baking.
Figure 32B:
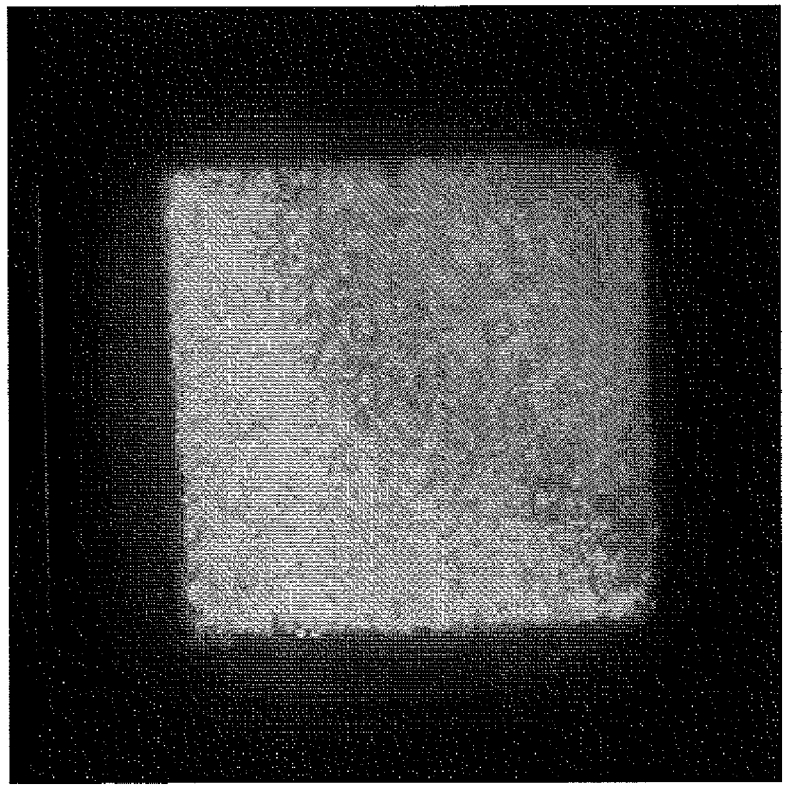
FIG. 32B is an image showing fluorescence board luminescence due to electron emissions of a field emission electrode after being subjected to baking processing for one hour.
Figure 33:
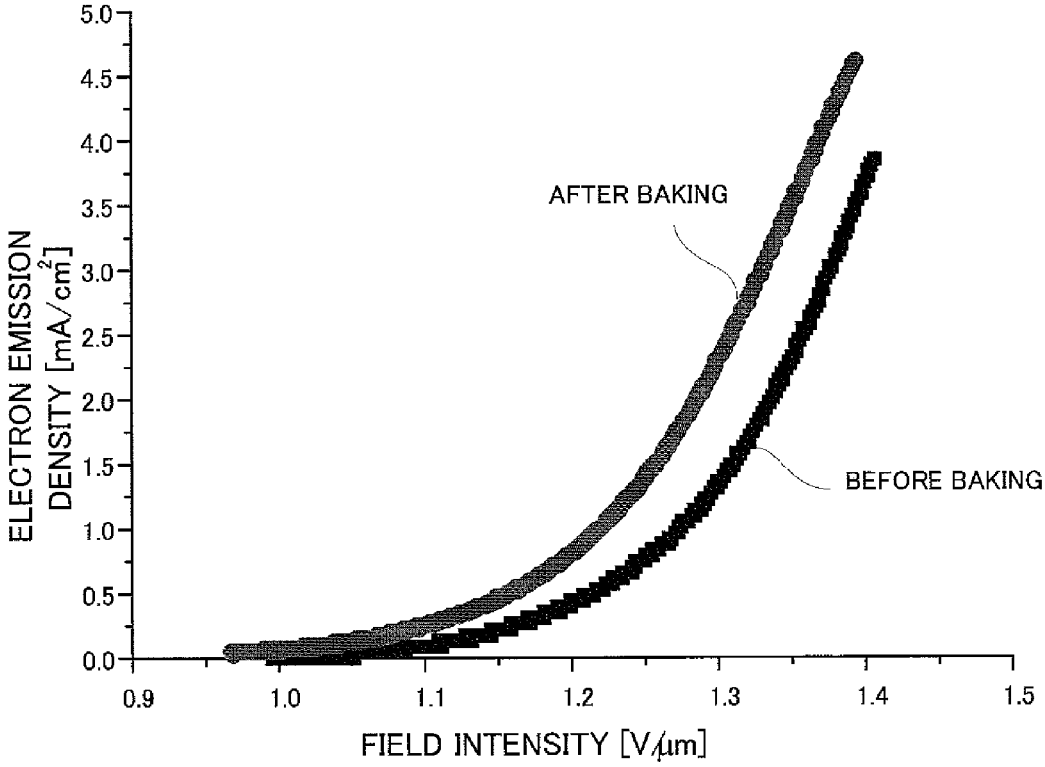
FIG. 33 is a graph showing I-V characteristics before and after baking.

FIG. 32A is an image showing the appearance of fluorescence board luminescence due to electron emissions of a field emission electrode that is not subjected to humidification processing after being subjected to aging processing and before baking. FIG. 32B is an image showing the fluorescence board luminescence due to electron emissions of the field emission electrode after being subjected to baking processing for one hour after being subjected to aging processing but without being subjected to humidification processing. FIG. 33 is a graph showing I-V characteristics before and after baking.

It can be understood from FIG. 32A that there is a region on the upper right where there are no emissions before baking. However, after baking, the emitting region increases and an improvement can be seen in the electron emission characteristics, as shown in FIG. 33. On the other hand, there is slight deterioration in the electron emission characteristics as a result of baking the electron emission element subjected to humidification aging as described above at 800 degrees centigrade. This can be considered to be because, in aging with no humidification, a large number of inactive electron emission sites remain. These inactive electron emission sites are then made active (the cause of the hindrance to electron emissions is removed) as a result of thermal etching by vacuum heating.

It is therefore possible to improve the electron emission characteristics of the field emission electrode by implementing aging and baking processing but not implementing humidification processing. However, it is preferable to implement humidification processing because the increase in electron emission characteristics and the averaging of the electron emission density is greater when humidification processing is implemented.

Second Embodiment

Next, the case where humidification processing is implemented, aging is carried out, and baking processing is carried out using a processing apparatus employing a copper sheet that is a hydrophobic material as an anode is compared with the case where aging is carried out using a processing apparatus employing a fluorescent substance (ZnO:Zn) as an anode while implementing the humidification processing as in the first embodiment in order to look at the results for the point of using a hydrophilic material as the anode facing the field emission electrode at the processing apparatus implementing the aging, with baking processing then being implemented. FIGS. 24 to 33 of the first embodiment give data for carrying out aging and then baking processing using processing apparatus on a glass plate coated with a fluorescent substance (ZnO:Zn) on ITO as an anode in addition to implementing humidification processing. In the second embodiment, only data for the case where a copper sheet is used as the anode in place of the glass plate coated with a fluorescent substance (ZnO:Zn) on ITO is shown.

First, the electron emission film is formed by a CVD apparatus on a substrate under the conditions described above and the field emission electrode is made, as in the first embodiment. Next, the electron emission film of the field emission electrode formed in this manner is subjected to humidification processing. Specifically, the humidification processing takes place under a high humidity environment by exposure for around one minute at a room temperature of, for example, 25 degrees centigrade at 100% humidity. Drying then takes place for approximately ten minutes at 50% humidity.

Next, aging is carried out using the processing apparatus 200 under conditions of an applied voltage pulse wave height of 6 kV (1.4V/μm), a pulse frequency of 500 Hz, and a duty ratio of 0.5%. A copper sheet is used as the anode of the processing apparatus.

Figure 34A:
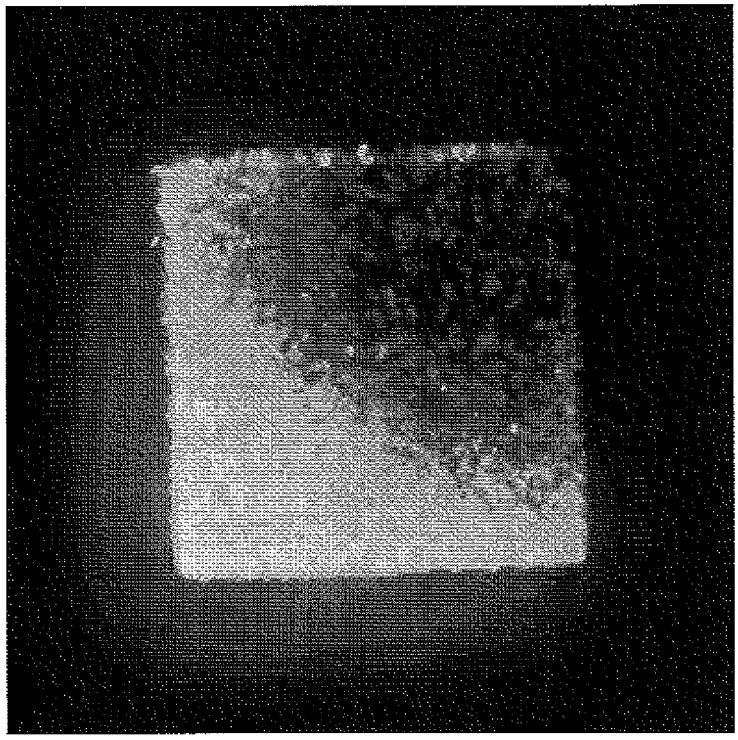
FIG. 34A is an image showing the appearance of fluorescence board luminescence due to electron emissions of a field emission electrode before aging.
Figure 34B:
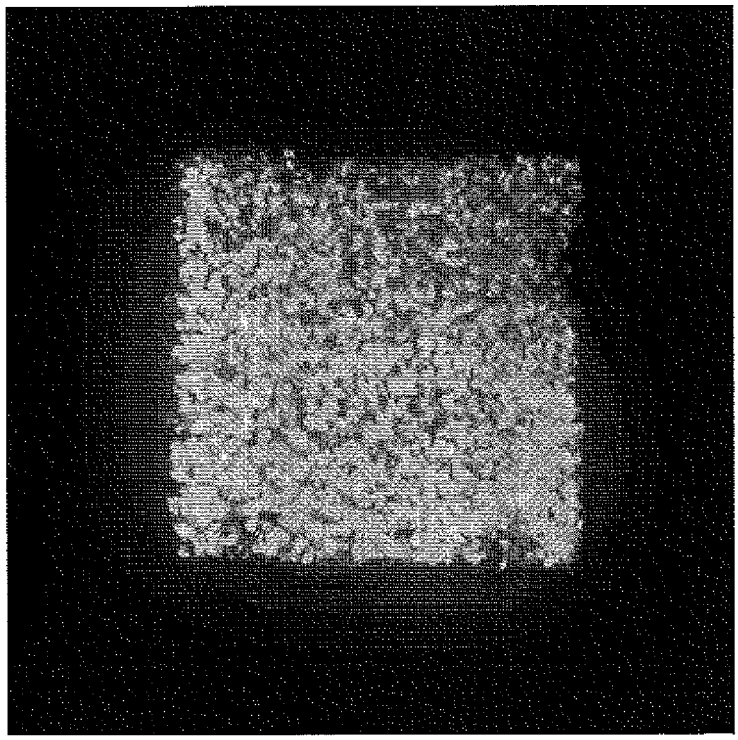
FIG. 34B is an image showing fluorescence board luminescence due to electron emissions of the field emission electrode after being subjected to aging processing for one hour.
Figure 35:
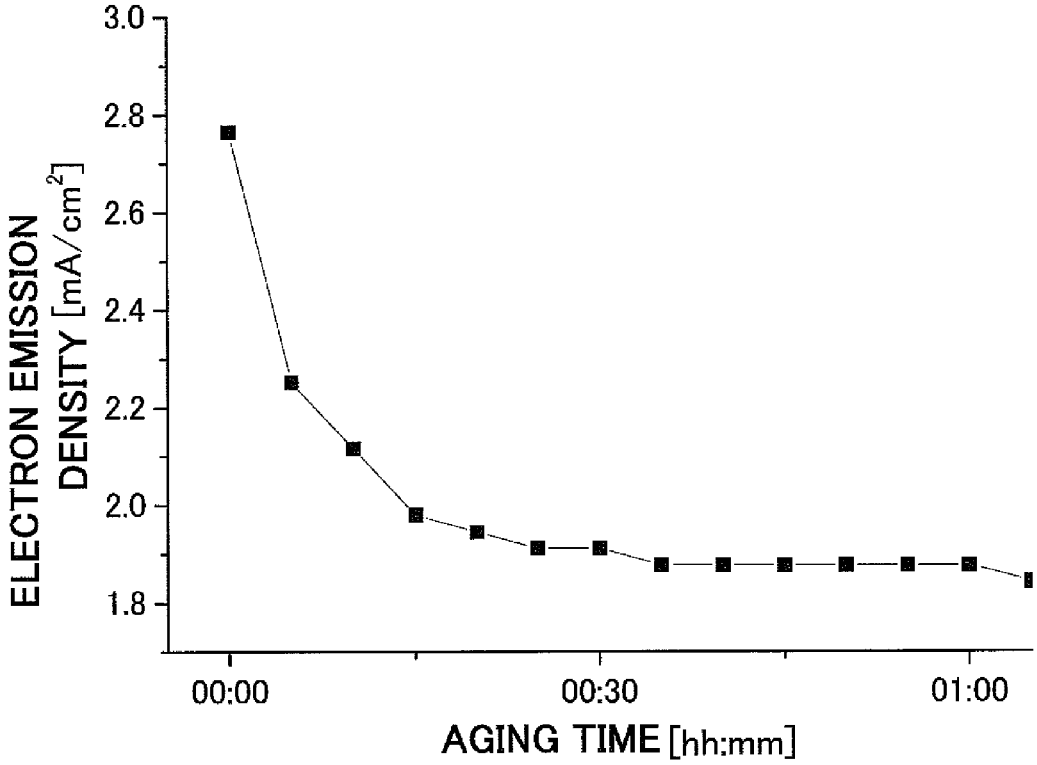
FIG. 35 is a graph showing the change in electron emission density over time when a gate is on (1.4V/μm)

The appearance of fluorescence board luminescence due to electron emissions of the field emission electrode before humidification aging (directly after film-forming) is shown in FIG. 34A. FIG. 34B is an image showing fluorescence board luminescence due to electron emissions of the field emission electrode after being subjected to aging processing for one hour at the humidified electron emission film. FIG. 35 is a graph showing the change in maximum electron emission density over time when a pulse voltage (1.4 V/μm) is applied to the electron emission film after carrying out humidification and aging.

The extent of emissions at the region on the upper right of FIG. 34A is weak compared with other regions and it is clear that the field emission electrode has a bias in the electron emission characteristic directly after film-forming. With regards to this, the field emission electrode implementing the aging processing as shown in FIG. 34B emits at the region on the upper right and exhibits emissions over its entire area but the electron emission density is reduced overall. Further, it is clear from FIG. 35 that the electron emission density reduces in accordance with elapsing of the aging time.

Figure 36:
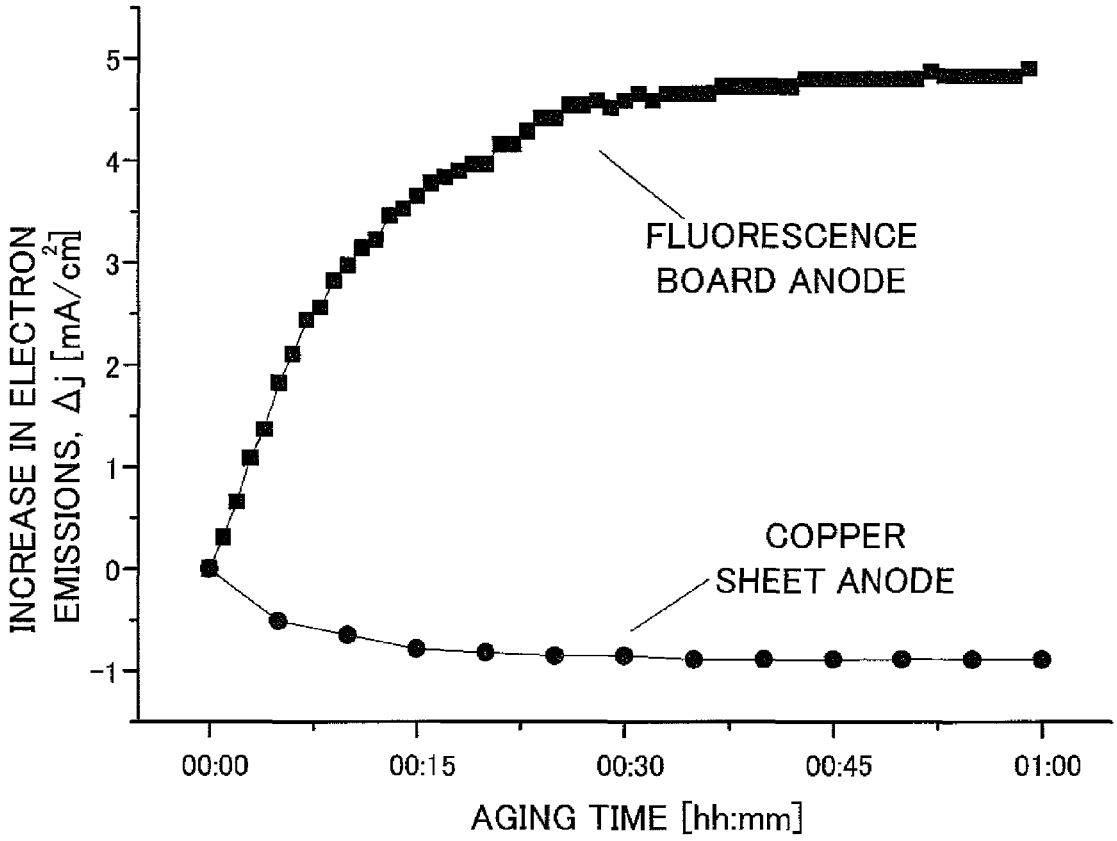
FIG. 36 is a graph showing change in an extent of increase in electron emissions when aging is carried out using a fluorescence board and when aging is carried out using a copper sheet.

In FIG. 36, change in the amount of increase in the electron emissions when aging is carried out using a fluorescence board provided with a fluorescent substance (ZnO:Zn), ITO and glass on an electron emission film subjected to humidification processing (fluorescence board aging) and when aging is carried out using a copper sheet at an electron emission film subjected to humidification processing is shown. It is clear from FIG. 36 that the quantity of electron emissions continues to increase up to one hour in the case of using a fluorescence board, whereas the quantity of electron emissions falls with elapses of time when a copper sheet is used.

When aging is implemented in this way using a hydrophobic material as an anode for the processing apparatus, bias of the electron emission density is averaged but the overall electron emission density is reduced. This can be considered to be because the water vapor pressure across the electrodes becomes too large, and the electron emission element incurs damage due to ion bombardment. The clean copper sheet surface is hydrophobic and the quantity of water molecules absorbed is smaller than for the fluorescence board. It can therefore be considered that the water vapor pressure between the electrodes becomes higher than when using a fluorescence board as a result of water vapor emitted together with the emission of electrons and damage is therefore incurred.

Next, the field emission electrode subjected to aging processing is baked using vacuum heating. Specifically, the pressure when starting baking is taken to be $5\times10^{-4}$ Pa or less, the temperature is taken to be 800 degrees centigrade, and the baking time is taken to be one hour.

Figure 37A:
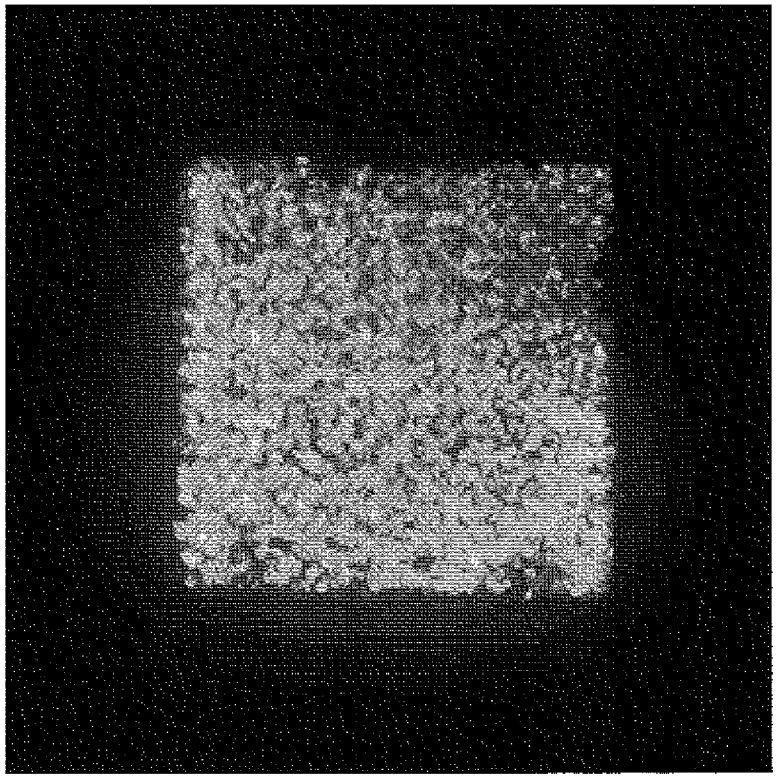
FIG. 37A is an image showing the appearance of fluorescence board luminescence due to electron emissions of a field emission electrode before baking.
Figure 37B:
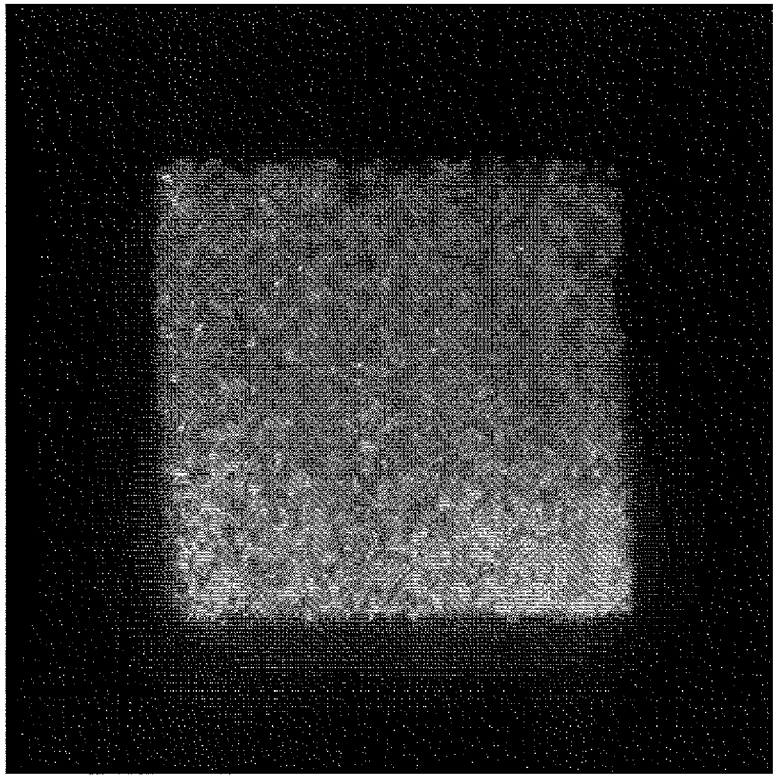
FIG. 37B is an image showing fluorescence board luminescence due to electron emissions of a field emission electrode after being subjected to baking processing for one hour.
Figure 38:
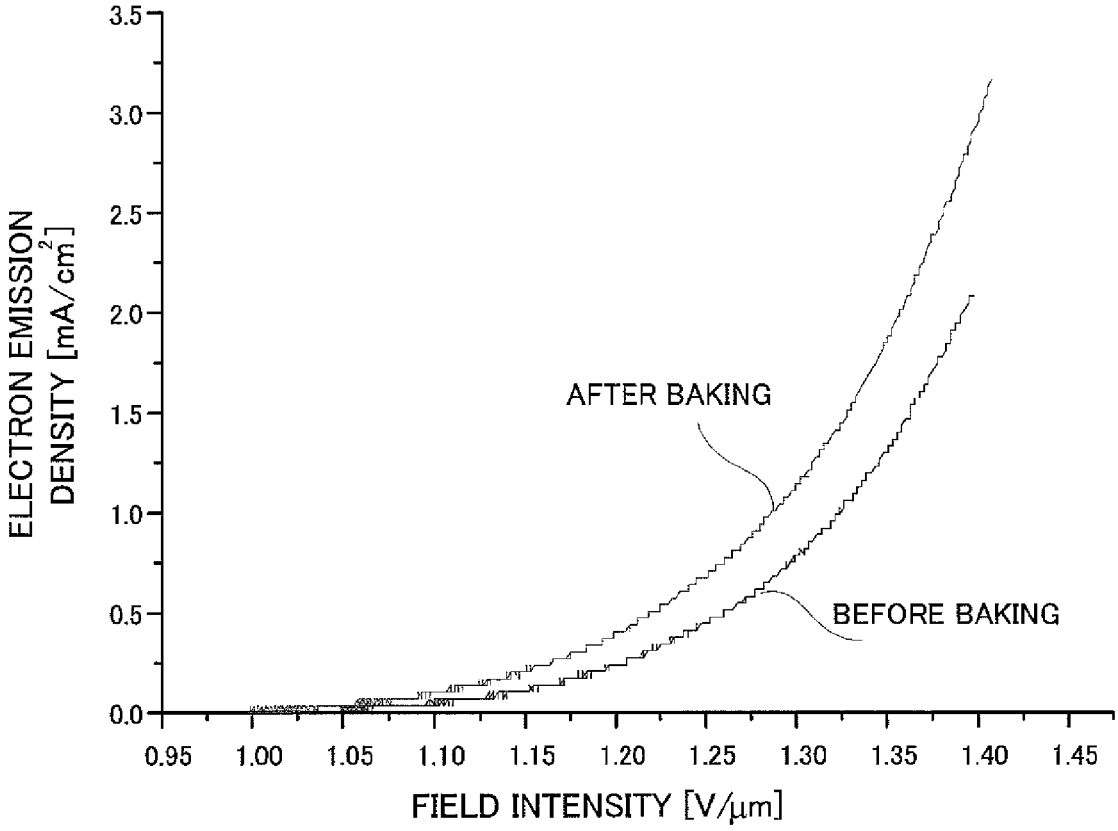
FIG. 38 is a graph showing I-V characteristics before and after baking.

The appearance of the fluorescence board luminescence due to electron emissions of the field emission electrode before baking and after being subjected to aging processing is shown in FIG. 37A. FIG. 37B is an image showing fluorescence board luminescence due to electron emissions of a field emission electrode after humidification processing, after being subjected to aging using a copper sheet, and after being subjected to baking processing for one hour. FIG. 38 is a graph showing I-V characteristics before and after the baking of FIG. 37A and FIG. 37B.

Comparing FIG. 37A and FIG. 37B and from FIG. 38, a tendency can be seen for uniformity of the electron emission characteristics to comparatively increase within the surface of the electron emission element before and after baking. This can be considered to be because when a copper sheet having a hydrophobic surface is used, it is difficult for water vapor to remain between the electrodes compared to when a fluorescence board is used (as with the case of aging without humidification). The aging therefore ends in a situation where a large number of inactive electron emission sites remain. These are then activated as a result of the cause of the impediment to electron emission being removed by the thermal etching at the time of vacuum heating and the electron emission characteristics are therefore improved.

Figure 39A:
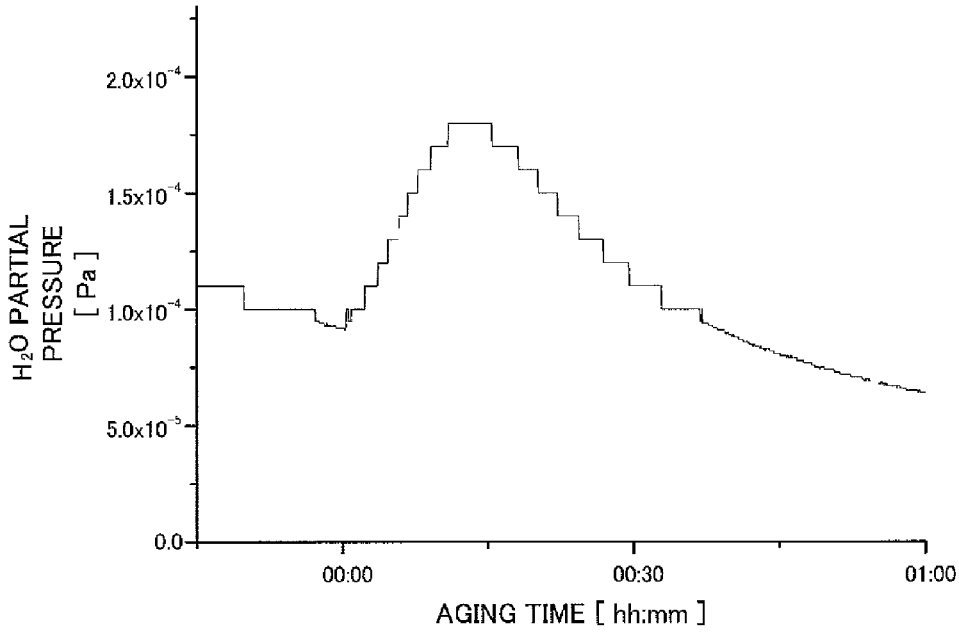
FIG. 39A is a graph showing partial pressure of $H_2O$ gas within a chamber in a humidification aging process when a copper sheet electrode is used.

The partial pressure of $H_2O$ gas in the chamber in the aging process using a copper sheet as an anode for the processing apparatus for the electron emission film subjected to humidification processing is shown in FIG. 39A. Further, the change over time of partial pressure of the $H_2O$ gas when a fluorescence board is used as an anode for the processing apparatus for the electron emission film subjected to humidification processing is shown in FIG. 39B.

Figure 39B:
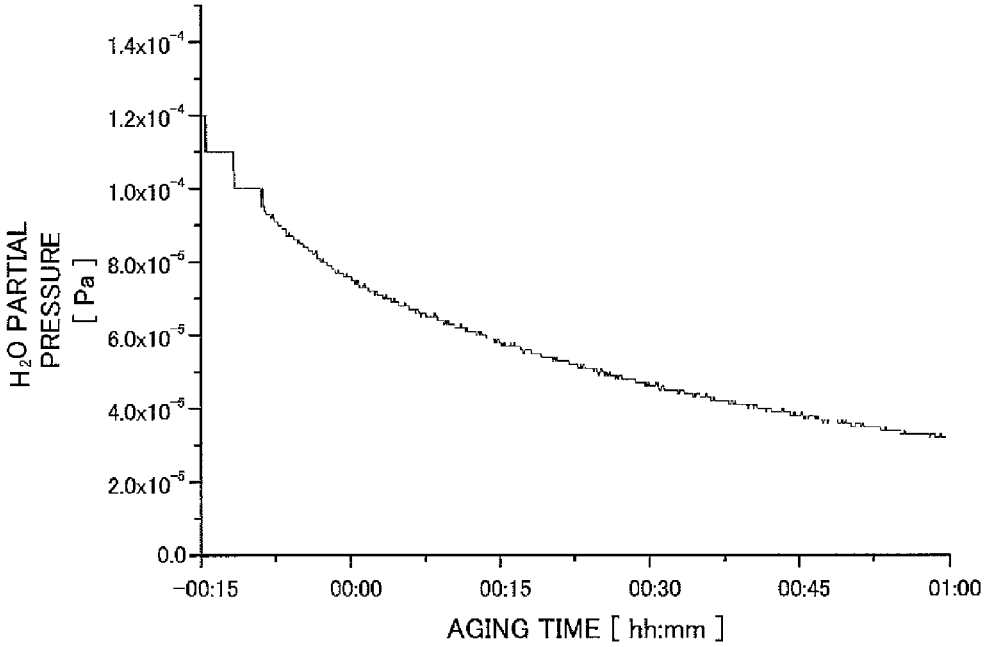
FIG. 39B is a graph showing change in partial pressure of $H_2O$ gas over time when a fluorescence board is used as an anode.

It can be seen from FIG. 39A and FIG. 39B that the partial pressure of water molecules rises in accompaniment with electron emissions at the copper sheet. However, in aging using a fluorescence board, even when the same humidification and aging processing is carried out, the aging exerts almost no influence on changes to partial pressure of the $H_2O$ within the chamber. The gas emission speed for the electrode system as a whole becomes small as a result of a large portion of the $H_2O$ gas emitted from the emitter in accompaniment with electron emissions being absorbed once at the hydrophilic fluorescent substance and the extent of this change can be considered small enough to be ignored with respect to the gas emission speed from the chamber inner wall.

Third Embodiment

Next, the case of carrying out aging with a pulse voltage applied in a humidified state and the case of implementing aging with a direct current fixed voltage applied in a humidified state rather than a pulse are compared in order to see the effects of applying a pulse voltage.

First, the electron emission film is formed by a plasma CVD apparatus on a substrate under the conditions described above and the field emission electrode is made, as in the first embodiment. Next, the electron emission film of the field emission electrode formed in this manner is subjected to humidification processing. Specifically, the humidification processing takes place under a high humidity environment by exposure for around one minute at a room temperature of, for example, 25 degrees centigrade at 100% humidity. Drying then takes place for approximately 10 minutes at 50% humidity.

Next, at a processing apparatus adopting substantially the same configuration as the processing apparatus 200, aging is carried out where a distance between the electrodes of the anode 214 having the glass plate 214*a* provided with ITO and a fluorescence board of the fluorescent substance 214*b* and the electron emission film is taken to be 1.3 mm, an applied voltage is taken to be a fixed voltage of 1.65 kV (field intensity 1.27V/μm), and an initial current density is taken to be 1.8 mA/cm$^2$.

Figure 40:
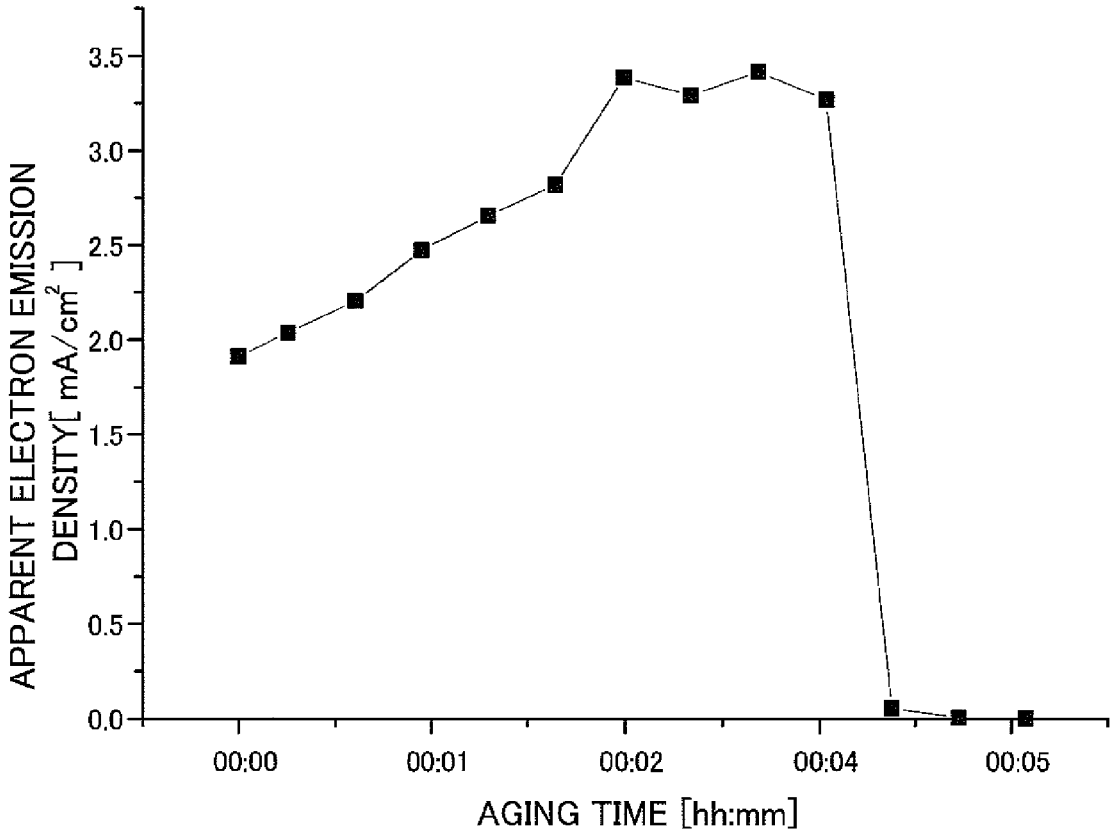
FIG. 40 is a graph showing change in electron emission density over time.

Change of time of the electron emission density for when aging is carried out is shown in FIG. 40. As is clear from FIG. 40, the electron emissions rapidly increase at the same time as the aging, and an electron emission density of 3.5 mA/cm$^2$ is reached 4 minutes after starting. However, after this, the electron emissions instantaneously become 0 mA/cm$^2$, and electron emissions are not recovered even for an intense field.

When a DC voltage is applied, desorption of the water molecules rapidly proceeds in accompaniment with electron emissions and water molecules absorbed at the fluorescence board are desorbed rapidly compared to the application of a pulse as a result of continual electron bombardment. The total pressure between the electrodes therefore rises.

Spark discharges therefore occur between the electrodes and damage is incurred by the whole surface of the emitter.

The present invention is not limited to the above embodiments, and various modification and applications are possible. For example, in the above embodiments, an example is given of the case where the electron emission film is constructed from three items, a carbon nanowall, a nanodiamond layer, and needle-shaped carbon rods. The electron emission film can also be constructed from just a carbon nanowall, can be constructed from a carbon nanowall and a nanodiamond layer, or can be constructed from a nanodiamond layer with no carbon nanowall.

Further, in the above embodiments, a hydrophilic fluorescent substance is used as the material for absorbing moisture emitted from the humidified electron emission film but this is by no means limiting providing that the member appropriately absorbs moisture within the processing apparatus.

This application is based on Japanese Patent Application No. 2007-256825 filed on Sep. 28, 2007 and including specification, claims, drawings and summary. The disclosure of the above Japanese Patent Application is incorporated herein by reference in its entirety.

An explanation is given illustrating various exemplary embodiments but the above embodiments do not limit the scope of the present invention. The scope of the present invention is limited only by the following claims.

What is claimed is:

1. A method of manufacturing a field emission electrode, comprising:

carrying out humidification processing to absorb water molecules at a surface of an electron emission film that emits electrons as a result of application of a voltage; and carrying out voltage application processing to apply an aging voltage across the humidified electron emission film and an electrode provided facing the electron emission film.

2. The method of manufacturing a field emission electrode according to claim 1, wherein at least a surface of the electrode facing the electron emission film is hydrophilic.

3. The method of manufacturing a field emission electrode according to claim 1, wherein a fluorescent substance is applied to a surface of the electrode facing the electron emission film.

4. The method of manufacturing a field emission electrode according to claim 1, further comprising heating the electron emission film in a vacuum state and removing water molecules from on the electron emission film.

5. The method of manufacturing a field emission electrode according to claim 4, wherein the heating is carried out at 550 to 1000 degrees centigrade.

6. The method of manufacturing a field emission electrode according to claim 1, wherein the electron emission film comprises a carbon nanowall having a graphene sheet.

7. The method of manufacturing a field emission electrode according to claim 6, wherein the electron emission film further comprises a microcrystal diamond film on the carbon nanowall.

8. The method of manufacturing a field emission electrode according to claim 7, wherein the electron emission film further comprises graphite projections formed so as to project upwards from the microcrystal diamond film.

9. The method of manufacturing a field emission electrode according to claim 1, wherein the aging voltage is a pulse voltage.

10. The method of manufacturing a field emission electrode according to claim 9, wherein the pulse voltage has a duty ratio of 0.2 to 5%.

11. The method of manufacturing a field emission electrode according to claim 9, wherein the pulse voltage is a voltage giving an electron emission density of 0.5 $mA/cm^2$ to 5 $mA/cm^2$ initially for the electron emission film.

12. The method of manufacturing a field emission electrode according to claim 9, wherein a cycle period for the pulse voltage is 250 Hz to 1 kHz.

13. The method of manufacturing a field emission electrode according to claim 1, wherein the water molecules are absorbed at the surface of the electron emission film as a result of exposure of the electron emission film to a humidified atmosphere.

14. A field emission electrode manufactured using a method of manufacturing a field emission electrode according to claim 1.

15. An apparatus for manufacturing a field emission electrode carrying out:

carrying out humidification processing to absorb water molecules at a surface of an electron emission film that emits electrons as a result of application of a voltage; and applying an aging voltage across the humidified electron emission film and an electrode provided facing the electron emission film.

* * * * *